US005589434A

United States Patent [19]

Takahara et al.

[11] Patent Number: 5,589,434

[45] Date of Patent: Dec. 31, 1996

[54] RECEPTOR LAYER TRANSFER SHEET, THERMAL TRANSFER SHEET, THERMAL TRANSFER METHOD AND APPARATUS THEREFOR

[75] Inventors: Hidetake Takahara; Takeshi Ueno; Katsuyuki Oshima; Mikio Asajima; Mineo Yamauchi, all of Tokyo-to, Japan

[73] Assignee: Dai Nippon Printing Co., Ltd., Tokyo-to, Japan

[21] Appl. No.: 399,845

[22] Filed: Mar. 7, 1995

Related U.S. Application Data

[62] Division of Ser. No. 103,360, Aug. 6, 1993, Pat. No. 5,424,267, and a division of Ser. No. 735,871, Jul. 25, 1991, Pat. No. 5,260,256.

[30] Foreign Application Priority Data

| | | | |
|---|---|---|---|
| Jul. 27, 1990 | [JP] | Japan | 2-197806 |
| Sep. 27, 1990 | [JP] | Japan | 2-255165 |
| Sep. 27, 1990 | [JP] | Japan | 2-255166 |
| Nov. 29, 1990 | [JP] | Japan | 2-325470 |
| Dec. 25, 1990 | [JP] | Japan | 2-412857 |
| Jan. 17, 1991 | [JP] | Japan | 3-15697 |
| Jan. 17, 1991 | [JP] | Japan | 3-15699 |
| Apr. 22, 1991 | [JP] | Japan | 3-116609 |

[51] Int. Cl.[6] ..... B41M 5/035; B41M 5/38

[52] U.S. Cl. ..... 503/227; 156/235; 428/195; 428/313.3; 428/354; 428/913; 428/914

[58] Field of Search ..... 428/195, 321.5, 428/913, 914, 313.3, 354; 503/227; 8/471; 156/235

[56] References Cited

U.S. PATENT DOCUMENTS

| | | | |
|---|---|---|---|
| 4,565,737 | 1/1986 | Nishide | 428/321.5 |
| 4,923,848 | 5/1990 | Akada et al. | 503/227 |

*Primary Examiner*—B. Hamilton Hess
*Attorney, Agent, or Firm*—Ladas & Parry

[57] ABSTRACT

There is provided a receptor layer transfer sheet which is capable of providing images of high quality on a transfer receiving material having an unsmooth surface, even when it is used in combination with a conventional thermal transfer material.

There is also provided a thermal transfer sheet which is capable of providing images of high quality on a transfer receiving material having an unsmooth surface.

There is further provided a thermal transfer method and a thermal transfer apparatus which are capable of providing images of high quality and do not require a special detection mark provided in (or on) a thermal transfer sheet to be used in combination therewith.

8 Claims, 5 Drawing Sheets

RECEPTOR LAYER TRANSFER SHEET, THERMAL TRANSFER SHEET, THERMAL TRANSFER METHOD AND APPARATUS THEREFOR

This is a divisional of application Ser. No. 08/103,360 filed on Aug. 6, 1993, now U.S. Pat. No. 5,424,267 and a Division of Ser. No. 07/735,871 (Jul. 25, 1991) now U.S. Pat. No. 5,260,256.

BACKGROUND OF THE INVENTION

The present invention relates to a receptor layer transfer sheet and a thermal transfer sheet, and more specifically to a thermal transfer sheet and a receptor layer transfer sheet capable of providing images of high quality and high image density even on a transfer receiving material having an unsmooth surface.

The present invention also relates to a thermal transfer method and a thermal transfer apparatus, and more specifically to a thermal transfer method and an apparatus to be used therefor which are capable of providing images of high quality by using a thermal transfer system.

According to the present invention, it is possible to form gradation images such as photo-graphic images together with words and marks on ready made transfer receiving materials such as name cards, post cards, leaflets, curriculum vitaes, resumes, identification cards, licenses, commuter passes, membership cards, passports, notebooks, and coupon tickets.

Heretofore, various thermal transfer methods are known. Among these, there has been proposed a method wherein a sublimable dye (or subliming dye) is used as a recording agent, and is carried on a substrate sheet such as paper and plastic film to obtain a thermal transfer sheet, and various full color images are formed on a transfer receiving material such as paper and plastic film having thereon a dye receptor layer by using the resultant thermal transfer sheet. In such a case, a thermal head of a printer is used as heating means so that a large number of color dots of three or four colors are transferred to the transfer receiving material under heating in a very short period of time. As a result, a full color image of an original is reproduced by using the multi-color color dots.

The thus formed images are very clear and are excellent in transparency since the dyes are used therein as a colorant. Accordingly, these images are excellent in half tone reproducibility and gradation characteristic and are substantially the same as the images formed by the conventional offset printing and gravure printing. Further, when the above image forming method is used, there can be formed images of high quality which are comparable to full color photographic images.

In the above image forming method, however, the transfer receiving material on which the above mentioned images can be formed is restricted to a plastic sheet having a dyeing property (or dyeability) which is dyeable by a dye, paper on which a dye receptor layer has been formed in advance, etc.. Accordingly, the above mentioned method cannot provide an image directly on ordinary plain paper, etc... As a matter of course, when a receptor layer is formed on the surface of ordinary plain paper, the resultant paper can be subjected to such image formation. However, such a method generally requires a high cost, and it is difficult to apply this method to generally ready made transfer receiving materials such as post cards, memo papers, letter papers, and writing pads.

As a measure for solving such a problem, there is known a receptor layer transfer sheet which is capable of easily providing a dye receptor layer on an essential part (i.e., a part on which an image is to be formed) of the ready made transfer receiving material such as paper when an image is intended to be formed on the ready made transfer receiving material. As such a receptor layer transfer sheet, there has been proposed one comprising a substrate sheet having a releasability and a resin layer disposed thereon for forming a receptor layer, e.g., as disclosed in Japanese Laid Open Patent Application (JP-A, KOKAI) No. 264994/1987.

In a case where the receptor transfer sheet as described above is used so as to transfer the receptor layer to the transfer receiving material, substantially no problem is posed when the transfer receiving material comprises a coated paper having a smooth surface. However, when the transfer receiving material comprises plain paper, a post card, and other paper having a rough texture, the surface of such paper is composed of exposed fibers and is poor in surface smoothness. Accordingly, the receptor layer cannot uniformly be transferred to the surface of such paper and therefore white dropout or transfer failure occurs in the image formed on the resultant receptor layer, whereby high quality images cannot be obtained.

Further, when the receptor layer is partially transferred to the transfer receiving material so as to provide a small pattern or a pattern having a complicated configuration by means of a thermal head, etc., the film of the receptor layer is not necessarily cut properly so that the transfer thereof is not necessarily effected accurately.

In order to solve these problems, it is conceivable that the receptor layer is caused to have a large thickness (e.g., about 20 to 30 μm) so that the surface unevenness of the paper is filled with the receptor layer. In practice, however, when the thickness of the receptor layer is increased, there occur various problems such that the thermal efficiency at the time of the transfer is lowered, cutting of the film becomes poor, and the film thickness becomes uneven. As a result, it is practically difficult to transfer the receptor layer per se, and the above problems cannot be solved.

As a measure for further simplifying the above operation, there has been proposed a thermal transfer sheet such that dye layers of yellow, magenta, and cyan (and optionally black, as desired) are sequentially formed on the surface of a continuous substrate film, and then a transfer receptor layer is formed on the same surface of the substrate film (Japanese Laid Open Patent Application Nos. 84281/1986 and 297184/1987). When such a thermal transfer sheet is used, the receptor layer is first transferred to a transfer receiving material, and then the dye layer of the respective colors are transferred to the receptor layer to form a full color image.

However, when the above thermal transfer sheet is used, it is required that the dye layer is firmly bonded to the substrate film, because the dye layer is liable to be transferred when the bonding therebetween is low. On the other hand, it is required that the receptor layer is bonded to the substrate film so as to provide an appropriate bonding strength. When the bonding strength is low, the peeling thereof is easy but the film cutting becomes poor. On the other hand, the bonding strength is too high, transfer failure occurs. As a result, the above requirements or performances for the dye layer and the receptor layer are antagonistic to each other.

There has also been proposed a method wherein a polyester film having a surface with an improved bonding property is used as a substrate film. However, the above antagonistic performances have not been satisfied even when such an improved polyester film is used.

SUMMARY OF THE INVENTION

An object of the present invention is to solve the above problems encountered in the prior art.

A more specific object of the present invention is to provide a receptor layer transfer sheet and a thermal transfer sheet which are capable of providing images of high quality even on a transfer receiving material having an unsmooth surface.

Another object of the present invention is to provide a thermal transfer method and a thermal transfer apparatus which are capable of providing images of high quality on a transfer receiving material by use of a thermal transfer system.

According to a first embodiment of a first aspect of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer contains bubbles.

According to the above first embodiment, images having a high quality and a high image density can be formed even on rough paper, etc., having an unsmooth surface.

According to a second embodiment of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer comprises a vinyl chloride/vinyl acetate copolymer having an average degree of polymerization of 400 or below.

According to the above second embodiment, the dye receptor layer can accurately be provided only to a desired portion of an image receiving sheet.

According to a third embodiment of the present invention, there is provided a receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and an adhesive layer disposed on the intermediate layer; the dye receptor layer contains a release agent; and the intermediate layer functions as a barrier layer such that it prevents the release agent from migrating from the dye receptor layer to the adhesive layer.

According to the above third embodiment, the releasability is not deteriorated so as not to cause abnormal transfer even after the receptor layer transfer sheet is stored for a long period of time.

According to a fourth embodiment of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer contains a white pigment and bubbles.

According to a fifth embodiment of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer contains bubbles covered with a white pigment.

According to the above fourth and fifth embodiments, images having a high quality and a high image density can be formed even on rough paper, etc., having different whiteness or an unsmooth surface.

According to a sixth embodiment of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer contains a foaming agent which has not been subjected to foaming operation.

According to the above sixth embodiment, the unevenness which has been formed by the heat and pressure due to a thermal head at the time of image formation can easily be restored, whereby the surface of the resultant image can be retained smooth.

According to a seventh embodiment of the present invention, there is provided a receptor layer transfer sheet comprising a substrate sheet and a transferable layer disposed on one side surface of the substrate sheet, wherein the transferable layer contains a foaming agent which has not been subjected to foaming operation and comprises a resin having a glass transfer point (Tg) of −20° C. to 70° C.

According to an eighth embodiment of the present invention, there is provided a receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and an adhesive layer disposed on the intermediate layer; and the intermediate layer comprises at least one resin selected from a resin which has at least partially been crosslinked and an acrylic resin.

According to a ninth embodiment of the present invention, there is provided a receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and an adhesive layer disposed on the intermediate layer; and the intermediate layer comprises a resin having a glass transition point (Tg) of −20° C. to 70° C.

According to a tenth embodiment of the present invention, there is provided a receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and an adhesive layer disposed on the intermediate layer; and the intermediate layer comprises a filler.

According to the above seventh, eighth, ninth and tenth embodiments, even when a transferred image is formed on paper having a rough texture and having a surface composed of exposed fibres, the fibres or unevenness does not appear on the surface of the receptor layer; whereby images having a high quality and a high image density without white dropout or image deficiency can be formed.

According to an eleventh embodiment of the present invention, there is provided a receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and a bubble containing layer disposed on the intermediate layer.

According to a twelfth embodiment of the present invention, there is provided a receptor layer transfer sheet comprising a substrate sheet and a transferable layer disposed on one side surface of the substrate sheet, the transferable layer being peelable from the substrate sheet and comprising a dye receptor layer, wherein the transferable layer has a surface provided with a minute unevenness configuration.

According to the above eleventh and twelfth embodiments, there may be transferred a receptor layer which is capable of providing images having a high quality and a high image density without white dropout or image defect even onto rough paper, etc., having an unsmooth surface. According to a first embodiment of a second aspect of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a dye receptor layer, and a release layer is disposed between the transferable layer and the continuous substrate sheet.

According to the above first embodiment, the dye layer is caused to have a good adhesion property, while the receptor layer is caused to have an adhesion property within an appropriate range.

According to a second embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a dye receptor layer, and contains at least one species selected from a white pigment, a fluorescent brightener and bubbles.

According to the above second embodiment, color images of high quality may be formed regardless of the kind of the image receiving sheet to be used for the image formation.

According to a third embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a dye receptor layer, and has a thickness in the range of 3 to 40 μm.

According to the above third embodiment, good images may be formed without causing winding wrinkles (or creases).

According to a fourth embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a dye receptor layer, and the dye layer contains a component of a release agent.

According to the above fourth embodiment, there may be provided images of high quality which are excellent in the transferability of the receptor layer, film cutting property, peeling property at the time of image formation, adhesion property of the protective layer, etc..

According to a fifth embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a dye receptor layer, and an adhesive layer is disposed between the transferable layer and the continuous substrate sheet.

According to the above fifth embodiment, there may be provided a thermal transfer sheet wherein the dye layer has a good adhesion property, and the receptor layer has a good peeling property.

According to a sixth embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a superposition comprising a dye receptor layer, an intermediate layer disposed thereon, and an adhesive layer disposed on the intermediate layer; and the intermediate layer comprises a resin which has at least partially been crosslinked.

According to a seventh embodiment of the present invention, there is provided a thermal transfer sheet comprising a continuous substrate sheet, and a dye layer of at least one color and at least one transferable layer which are sequentially disposed on one side surface of the continuous substrate sheet, wherein the transferable layer comprises a superposition comprising a dye receptor layer, an intermediate layer disposed thereon, and an adhesive layer disposed on the intermediate layer; and the intermediate layer comprises a resin having a glass transition point (Tg) of −20° C. to 70° C.

According to the above sixth and seventh embodiments; the entirety of the transferable layer may be caused to have a small thickness, when the thermal transfer sheet is in the form of a composite thermal transfer sheet.

According to a third aspect of the present invention, there is provided a thermal transfer method, comprising:

superposing a thermal transfer sheet on an image receiving sheet in a thermal transfer apparatus, and supplying heat to the thermal transfer sheet from the back surface side thereof, thereby to transfer a dye from the thermal transfer sheet to the image receiving sheet, the thermal transfer sheet comprising a continuous substrate sheet, and a dye layer of at least one color and at least one transferable layer which are sequentially disposed on one side surface of the continuous substrate sheet, the thermal transfer sheet being white and comprising a dye receptor layer;

wherein detection light is supplied from a light source provided in the thermal transfer apparatus to the thermal transfer sheet, and the resultant reflection or interception of the detection light based on the transferable layer is detected, thereby to detect the presence of the transferable layer.

According a fourth aspect of the present invention, there is provided a thermal transfer apparatus, comprising:

an image receiving sheet, means for conveying the image receiving sheet, a thermal transfer sheet, means for conveying the thermal transfer sheet, heat application means for superposing the thermal transfer sheet on the image receiving sheet and supplying heat to the thermal transfer sheet from the back surface side thereof, thereby to transfer a dye from the thermal transfer sheet to the image receiving sheet, and detection means comprising a light source and a light receptor, the thermal transfer sheet comprising a continuous substrate sheet, and a dye layer of at least one color and at least one transferable layer which are sequentially disposed on one side surface of the continuous substrate sheet; the transferable layer being white and comprising a dye receptor layer;

wherein detection light is supplied from the light source to the thermal transfer sheet and the resultant reflection or interception of the detection light based on the transferable layer is detected, thereby to detect the presence of the transferable layer.

According to the above third and fourth aspect of the present invention, the transferable layer comprising the dye receptor layer may function as a detection mark, and it is not necessary to form a special detection mark in the thermal transfer sheet and not necessary to provide a printing unit for printing a detective mark at production line of the thermal transfer sheet.

These and other objects, features and advantages of the present invention will become more apparent upon a consideration of the following description of the preferred embodiments of the present invention taken in conjunction with the accompanying drawings.

DESCRIPTION OF PREFERRED EMBODIMENTS

Hereinbelow, the present invention will be specifically described with reference to preferred embodiments thereof.

Figure 1:
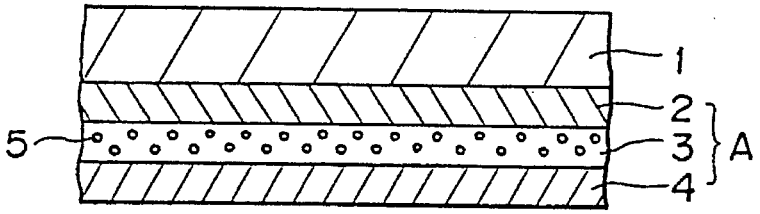
FIGS. 1 and 4 to 6 are schematic sectional views each showing a receptor layer transfer sheet according to an embodiment of the present invention.

Referring to FIG. 1, a receptor layer transfer sheet according to the present invention comprises a substrate sheet 1 and a transferable layer A comprising a dye receiving layer 2 disposed thereon, wherein the transferable layer A contains bubbles. In a preferred embodiment of the present invention, the intermediate layer 3 and/or the adhesive layer 4 included in the transferable layer A contains bubbles.

When the transferable layer A is transferred to rough paper by using the above receptor layer transfer sheet, since the transferable layer A containing the bubbles 5 is soft, the unevenness of the rough paper 6 is filled with the transferable layer A and the bubbles 5 are simultaneously crushed due to the printing pressure at the time of the transfer operation. As a result, the transferable layer A is thinned and the surface of the receptor layer 2 is retained smooth.

The substrate sheet 1 to be used in the present invention may be the same as that used in the conventional thermal transfer sheet as such. However, the substrate sheet 1 is not restricted to such a conventional substrate sheet, but may also be another substrate sheet.

Specific examples of the preferred substrate sheet may include thin papers such as glassine paper, capacitor paper, and paraffin paper; plastic sheets or films comprising plastics such as polyester, polypropylene, cellophane, polycarbonate, cellulose acetate, polyethylene, polyvinyl chloride, polystyrene, nylon, polyimide, polyvinylidene chloride, and monomer; substrate sheets comprising a composite of such a plastic sheet or film and the paper as described above; etc..

The thickness of the substrate sheet may appropriately be changed corresponding to the material constituting it so as to provide suitable strength and heat resistance thereof, but the thickness may preferably be 3 to 100 μm.

It is preferred to form a release layer on the surface of the substrate sheet 1, prior to the formation of the receptor layer 2. Such a release layer may be formed from a release agent such as waxes, silicone wax, silicone resins, fluorine containing resins, and acrylic resins. The release layer may be formed in the same manner as that for a receptor layer as described hereinbelow. It is sufficient that the release layer has a thickness of about 0.5 to 5 μm. When a matte (or matted) receptor layer is desired after the transfer operation, it is possible to incorporate various particles in the release layer, or to use a substrate sheet having a matted surface on the release layer side thereof so as to provide a matted surface. As a matter of course, when the above substrate sheet has an appropriate releasability, it is not necessary to form the release layer.

The dye receptor layer 2 to be formed on the surface of the above substrate sheet is one such that it may receive a sublimable dye migrating from (or transferring from) the thermal transfer sheet after it is transferred to an arbitrary (or optional) transfer receiving material, and may retain the thus formed image.

Specific examples of the resin for forming the dye receptor layer 2 may include: polyolefin type resin such as polypropylene; halogenated polymer such as polyvinyl chloride and polyvinylidene chloride; vinyl type polymers such as polyvinyl acetate and polyacrylic acid esters; polyester type resin such as polyethylene terephthalate and polybutylene terephthalate; polystyrene type resins; polyamide type resins; copolymer resins comprising olefin such as ethylene and propylene, and another vinyl monomer; ionomers, cellulose type resins such as cellulose diacetate; polycarbonate; etc.. Particularly preferred examples thereof may include vinyl type resins and polyester type resins.

Preferred examples of the release agent to be used as a mixture with the above resin may include silicone oil, phosphoric acid ester type surfactants, fluorine containing surfactants, etc.. Particularly preferred examples thereof may include silicone oil. Such a silicone oil may preferably be a modified silicone oil such as epoxy modified silicone oil, alkyl modified silicone oil, amino modified silicone oil, carboxyl modified silicone oil, alcohol modified silicone oil, fluorine modified silicone oil, alkylaralkylpolyether modified silicone oil, epoxy•polyether modified silicone oil, and polyether modified silicone oil.

The release agent may be used either singly or as a combination of two or more species thereof. The release agent may preferably be added to the dye receptor layer in an amount of 0.5 to 30 wt. parts with respect to 100 wt. parts of the resin constituting the dye receptor layer. If such an addition amount is not in the above range, there can occur a problem such that substrate sheet 1 sticks to the dye receptor layer 2 or the printing sensitivity can be lowered, in some cases. When the above release agent is added to the dye receptor layer 2, the release agent is bled or exuded to the surface of the receptor layer 2 after the transfer operation so as to form thereon a release layer.

The receptor layer 2 may be formed by applying a dispersion to one side surface of the above substrate sheet 1 and then drying the resultant coating. The dispersion may be prepared by adding an additive such as release agent, to the resin as described above as desired, and dissolving the resultant mixture in an appropriate organic solvent, or by dispersing the mixture in an organic solvent or water. The resultant dispersion may be applied onto the substrate sheet 1, e.g., by a gravure printing method, a screen printing method, a reverse roll coating method using a gravure plate, etc..

When the above receptor layer 2 is formed, a pigment or filler such as titanium oxide, zinc oxide, kaolin clay, calcium carbonate and silica fine powder can be added to the receptor layer 2 for the purpose of improving the whiteness of the dye receptor layer to further improve the clarity (or color definition) of the resultant transferred image and improving the film cutting of the receptor layer 2.

The dye receptor layer to be formed in the above manner can have an arbitrary thickness, but may generally have a thickness of 1 to 20 μm. Such a dye receptor layer may preferably comprise a continuous coating but may also be formed a discontinuous coating by using a resin emulsion or resin dispersion.

It is preferred to further dispose an adhesive layer 4 on the surface of the above receptor layer so as to improve the transferability of the receptor layer 2. The adhesive layer 4 may be formed by applying a solution of a resin and then drying the resultant coating. Such a resin may preferably comprise one showing good adhesion property at the time of heating, such as polyamide resin, acrylic resin, vinyl chloride resin, vinyl chloride-vinyl acetate copolymer resin, and polyester resin. The adhesive layer may preferably have a thickness of 0.5 to 10 μm.

In the present invention, it is possible to dispose an intermediate layer 3 between the receptor layer 2 and the adhesive layer 4 as described above. The intermediate layer functions so as to prevent the release agent contained in the receptor layer 2 from migrating to the adhesive layer 4.

The material constituting the intermediate layer 3 may comprise a resin which is less compatible with the release agent. Specific examples of such a resin may include: vinyl chloride vinyl acetate copolymers, polyvinyl acetate resin, acrylic resin, polyamide resin and polystyrene resin. The intermediate layer 3 may preferably have a thickness of about 2 to 10 μm. The intermediate layer 3 may be formed in the same manner as that for the above receptor layer.

The receptor layer transfer sheet according to the present invention is characterized in that bubbles are incorporated in at least one layer constituting the transferable layer A to be formed in the manner as described above. The method of incorporating the bubble in the above layer, may be one wherein a foaming agent is incorporated in a coating liquid to be used at the time of the formation of each of the respective layers, and the foaming agent is subjected to foaming at an appropriate temperature at the time of or after the drying of the coating formed by the application of the coating liquid.

The foaming agent to be used for such a purpose may be one which is capable of being decomposed at a high temperature to generate a gas such as oxygen, carbonic acid gas, and nitrogen. Specific examples of such a foaming agent may include: decomposition type foaming agents such as dinitropentamethylenetetramine, diazoaminobenzene, azobisisobutyronitrile, and azodicarboamide; and known foaming agent (or foaming material) such as so called "micro balloon" which may be prepared by microencapsulating a low boiling point liquid such as butane and pentane, with a resin such as polyvinylidene chloride and polyacrylonitrile. Further, it is also possible to use a foaming material which is prepared by subjecting the above micro balloon to foaming operation in advance.

The above foaming agent or foaming material may preferably be used in an amount such that the layer containing the bubbles may provide a foaming magnification (or expansion coefficient) in the range of about 1.5 to 20. Particularly preferred examples of the foaming agent may include the above micro balloon which can be subjected to the foaming operation at a relatively lower temperature. Samples thereof of various grades are available from Matsumoto Yushi K.K., and each of them may be used in the present invention.

In the present invention, the resin for forming the dye receptor layer may comprise a vinyl chloride-vinyl acetate copolymer having a degree of polymerization of 400 or below, more prefeably 150 to 350.

When the above vinyl chloride-vinyl acetate copolymer having a specific degree of polymerization is selected as the resin for forming the dye receptor layer, the film cutting of the receptor layer may be improved so that the dye receptor layer may accurately be imparted to a desired portion of an arbitrary image receiving sheet.

In the receptor layer transfer sheet according to the present invention a white pigment and bubbles and/or bubbles covered with (or coated with) a White pigment may be incorporated in at least one layer constituting the transferable layer. When the white pigment and the bubbles and/or the bubbles covered with the white pigment are incorporated in the above layer, it is preferred that the white pigment and the bubbles and/or the bubbles covered with the white pigment (or a foaming agent to be used for the formation thereof) are incorporated in a coating liquid to be used for formation of each layer, the coating liquid is applied onto a predetermined surface, and the foaming agent is subjected to the foaming operation at the time of or after the drying of the resultant coating.

The white pigment to be used for such a purpose may preferably be one having a strong hiding power such as titanium oxide and zinc oxide. The white pigment may be added to the receptor layer, intermediate layer and/or adhesive layer in an amount of about 1 to 200 wt. parts, with respect to 100 wt. parts of the resin constituting such a layer.

Further, the foaming agent to be used for such a purpose may be the same as that as described hereinabove.

Figure 3:
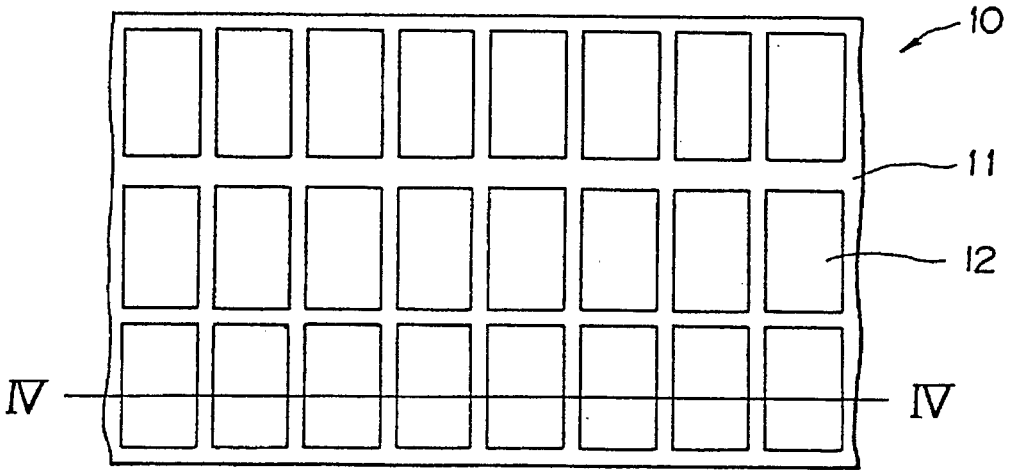
FIG. 3 is a schematic plan view showing the receptor layer transfer sheet according to an embodiment of the present invention.

FIG. 3 is a schematic plan view showing another embodiment of the receptor layer transfer sheet according to the present invention. Referring to FIG. 3, the receptor layer transfer sheet 10 in this embodiment comprises a substrate sheet 11 and a pattern of a receptor layer 12 disposed on the surface of the substrate sheet 11.

Figure 4:
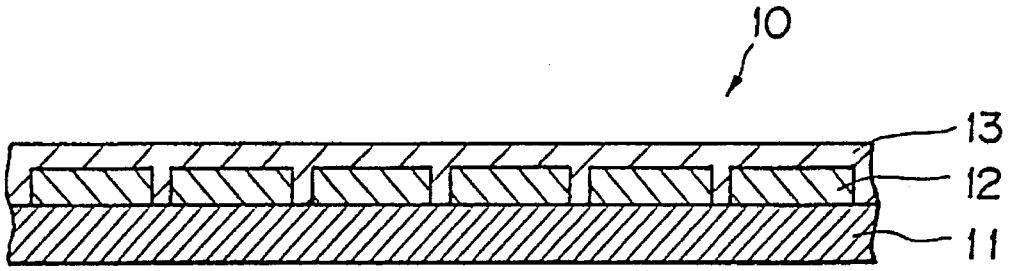

FIG. 4 is a schematic longitudinal sectional view showing a section of the receptor layer transfer sheet shown in FIG. 3 along the line of IV—IV, wherein an adhesive layer 13 is disposed on the entire surface of the substrate sheet 11 (inclusive of the surface of the receptor layer 12) on which the receptor layer 12 has been disposed.

As a matter of course, an intermediate layer (not shown) may also be disposed between the receptor layer 12 and the adhesive layer 13 in the same manner as in the embodiment as described above.

In this embodiment, since the receptor layer 12 is formed so that it may have a predetermined pattern in advance, the edge of the receptor layer transferred to a transfer receiving material becomes sharp.

In a further embodiment of the receptor layer transfer sheet according to the present invention, at least one layer constituting the transferable layer A as in shown in FIG. 1 contains fibers.

The fibers to be used in this embodiment may be those having a length which does not substantially impair the coating property of the coating liquid for the formation of such a layer. Specific examples of short fibers to be used for such a purpose may include: inorganic fibers (whisker, columnar crystal) such as potassium titanate fibers, silicone carbide fibers, silica glass fibers, boron nitride fibers, aluminum oxide fibers, and glass fibers; organic fibers such as nylon, acrylic resin, polyester, and cotton; etc.. The above fibers may preferably be white or colorless. These fibers can also be colored to a certain extent such that it does not substantially obstruct the image formation. Such fibers to be used in the present invention may preferably have a diameter of about 0.1 to 1 μm, a length of about 10 μm to 2 mm, and an aspect ratio of about 50:1.

In a case where the dye receptor layer, intermediate layer or adhesive layer is formed by using the above fibers and a resin, the fibers may preferably be used in an amount of about 0.1 to 40 wt. parts with respect to 100 wt. parts of the resin solid content, while the addition amount of the fibers can vary depending on the kind of the fibers actually used.

When the fibers are incorporated in the transferable layer A in such a manner, the transferred receptor layer does not collapse on the basis of the bridge effect of the fibers contained in the transferable layer, even when the transfer receiving material has unevenness to a certain extent. Accordingly, there is provided a receptor layer transfer sheet and a thermal transfer image receiving sheet which are capable of providing images having a high quality and a high image density without white dropout or image defect even on rough paper, etc., having an unsmooth surface.

In a further embodiment of the receptor layer transfer sheet according to the present invention, at least one layer constituting the transferable layer A as shown in FIG. 1 contains a foaming agent which is not substantially subjected to the foaming operation. The foaming agent in such a substantially non foaming state to be used for the above purpose may be one which can slightly foam but does not substantially foam at a temperature at which each of the respective layer is formed and the transferable layer is transferred. Preferred examples of such a foaming agent may include the foaming agents as described hereinabove.

The above foaming agent may be contained in any of the respective layers but may preferably be contained in the intermediate layer and/or adhesive layer, particularly preferably in a foaming agent layer disposed between the intermediate layer and the adhesive layer. When the foaming agent is contained in the receptor layer or the intermediate layer, it is possible that the foaming agent excessively foams due to the heat supplied from a thermal head so as to form some convexities. When the foaming agent is contained in the foaming agent layer, the excessive foaming of the foaming agent is suppressed by the intermediate layer. Particularly, in a case where a relatively hard film such as film of a crosslinked resin is used as the intermediate layer, the above mentioned excessive foaming prevention effect is most remarkable. On the other hand, when the foaming agent is contained in the adhesive layer, the excessive foaming is further suppressed but a lowering of adhesiveness may be caused.

In a further embodiment of the receptor layer transfer sheet according to the present invention, the intermediate layer constituting the transferable layer A as shown in FIG. 1 comprises one formed from an acrylic resin or a resin at least a part of which is crosslinked.

Such an intermediate layer has a function of preventing the fibers exposed to the surface of a transfer receiving material such as paper and the foaming agent excessivly foamed by beat from a thermal head from being exposed to the surface of the transferred receptor layer. The intermediate layer may preferably comprise a film having a hardness to a certain extent. Such a film may preferably comprise a resin which has been so modified that it has a certain reactive group selected from various species thereof. Specific examples of the modified resin may include: polyurethane resin, polyester resin, acrylic resin, polyethylene type resin, butadiene rubber, epoxy resin, vinyl chloride-vinyl acetate copolymer resin, polyamide type resin, binary or ternary copolymer resins comprising a monomer such as vinylchloride, vinyl acetate, ethylene and propylene, ionomer resin, cellulose type resins such as cellulose diacetate, polycarbonate, etc.. Particularly preferred examples thereof may include reactive acrylic resin and reactive polyester resin.

The crosslinking agent to be used for crosslinking the above resin may comprise: polyaldehyde, polyamine, polymethylol compound, polycarboxylic acid, polyepoxy compound, polyisocyanate, etc.. Particularly preferred examples of the crosslinking agent may include polyisocyanates. The method of crosslinking to be used for such a purpose may be known one. The degree of crosslinking may preferably be such that the resultant crosslinked film does not become too hard. More specifically, in the case of a polyester resin or acrylic resin having a hydroxyl functional group, it is preferred to use the polyisocyanate in an amount of about 0.5 to 30 wt. parts, with respect to 100 wt. parts of the above resin.

Figure 2:
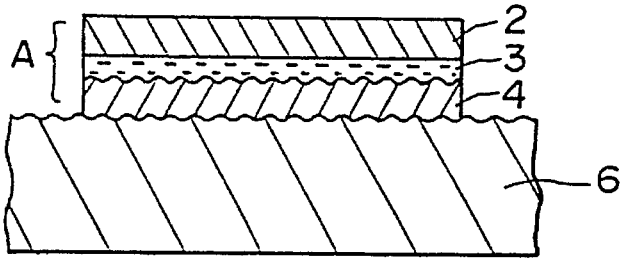
FIG. 2 is a schematic sectional view showing a state wherein a transferable layer is transferred to a transfer receiving material by using the receptor layer transfer sheet according to the present invention.

The intermediate layer to be formed in the above manner may generally have a thickness of about 0.5 to 10 μm. In the case of a thermal transfer sheet as shown in FIG. 2 wherein dye layers of respective colors and a transfer protection layer are sequentially formed on a predetermined surface, the dye layer generally has a thickness of about several microns. In a case where the transfer protection layer is too thick, there can occur a problem such as crease or wrinkle in some cases, when the composite thermal transfer material is wound up in a roll to be stored or is rewound at the time of the image formation. In such a case, in order to solve the above problem, it is preferred to form the receptor layer, intermediate layer and adhesive layer so that the total thickness of these layer is as small as possible. For example, it is preferred that the intermediate layer is caused to have a relatively small thickness of about 0.5 to 40 μm, and the other layers are formed so that the thickness thereof become as small as possible, whereby the total thickness is about 1 to 4 μm. Even when the total thickness is reduced to such an extent, since the intermediate layer comprise a relatively hard crosslinked film, it may suppress the ill effect due to the fibers exposed to the surface of the paper at the time of the transfer of the receptor layer.

In a further embodiment of the receptor transfer sheet according to the present invention, the resin constituting the intermediate layer of the transferable layer A as shown in FIG. 1 may comprise a filler. Such an intermediate layer has a function of preventing the fibers exposed to the surface of a transfer receiving material such as paper from being exposed to the surface of the transferred receptor layer, and a function of preventing the foaming agent excessively foamed by heat from a thermal head from forming holes on the transferred receptor layer.

In a further embodiment of the receptor transfer sheet according to the present invention, the resin constituting the intermediate layer of the transferable layer A as shown in FIG. 1 may comprise a resin having a Tg of −20° C. to 70° C.

Specific examples of the resin having a Tg of −20° C. to 70° C. (preferably −20° C. to 40° C.) may include: polyurethane resin, polyester resin, acrylic resin, polyethylene type resin, butadiene rubber, epoxy resin, vinyl chloride-vinyl acetate copolymer resin, polyamide type resin, binary or ternary copolymer resins comprising a monomer such as vinyl chloride, vinyl acetate, ethylene and propylene, ionomer resin, etc.. Particularly preferred examples of such a resin may include those which are capable of providing an intermediate layer having a tensile elongation at break in the range of 50 to 1000%.

If the Tg of the resin exceeds 70° C., or the tensile elongation at break thereof is below 50%, there occurs such problems as a lowering of flexivility of the transferred receptor layer, a white dropout in the image on the transferred receptor layer and a reduction of sensibility at thermal printing operation. On the other hand, if the Tg is too low, or the tensile elongation is too large, there occurs such a problem as a reduction of the film cutting property of the receptor layer. The abovementioned tensile elongation at break can be measured by the following manner.

Preparation of samples: A coating liquid for the intermodiate layer is applied on the release paper so as to provide a layer having a thickness (after drying) of 10 μm.

Then, a piece of 10 cm×1 cm is cut out from the resultant, and the release paper is peeled away from the piece.

Measurement: The piece is attached to Tensilon (mfd. by TOYO Seiki K.K.) and measured.

Figure 5:
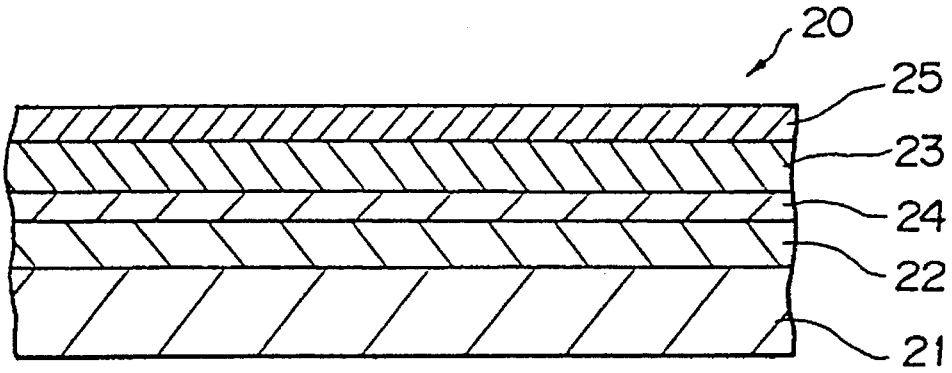

FIG. 5 is a schematic sectional view of an embodiment of the receptor layer transfer sheet according to the present invention. Preferring to FIG. 5, the receptor layer transfer sheet 20 in this embodiment comprises a substrate sheet 21 and a transferable layer disposed on one side surface of the substrate sheet 21. The transferable layer comprises a dye receptor layer 22, a bubble containing layer 23, an intermediate layer 24 disposed between the dye receptor layer 22 and the bubble containing layer 23, and an adhesive layer 25 disposed on the bubble containing layer 23. The bubble containing layer 23 constituting the transferable layer may be formed by applying a coating liquid containing a thermoplastic resin as a binder and bubbles to a predetermined surface and drying the resultant coating. Specific examples of the thermoplastic resin may include: polyurethane resin, acrylic resin, polyethylene type resin, butadiene rubber and epoxy resin.

Particularly preferred examples of such a thermoplastic resin may comprise a resin having a Tg of −20° C. to 70° C. The resin having a Tg of 70° C. or below may be capable of imparting a foaming effeciency of a foaming agent and a flexivility of the receptor layer. The resin having a Tg of −20° C. or above may be capable of imparting a film cutting property of the receptor layer.

As a method of incorporating the bubbles in the layer 23, there may be used a method wherein the bubbles per se are incorporated in the layer 23, and a method wherein a foaming agent is incorporated in the layer 23 and the foaming agent is subjected to the foaming operation after the formation of the layer 23.

The forming agent to be used for such a purpose may be any of the various foaming agents as described hereinabove. The bubble containing layer 23 may preferably have a thickness of about 2 to 20 μm.

The substrate sheet, dye receptor layer, intermediate layer, and adhesive layer to be used in this embodiment may be formed in the same manner as in the embodiment described above with reference to FIG. 1.

According to such a receptor transfer sheet 20 of this embodiment, in a case where an image is formed on a transfer receiving material by using a thermal head after the transfer thereto of the receptor layer, even when the bubbles are again expanded due to the heat supplied from the thermal head, no defect is caused in the receptor layer. As a result, there may be transferred the receptor layer which is capable providing images having a high quality and a high image density without white dropout or image defect even onto rough paper, etc., having an unsmooth surface.

Figure 6:
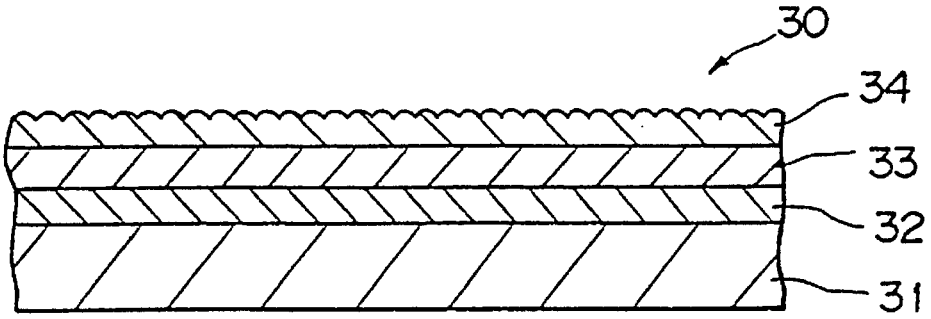

FIG. 6 is a schematic sectional view showing an embodiment of the receptor layer transfer sheet according to the present invention. Referring to FIG. 6, the receptor layer transfer sheet 30 in this embodiment comprises a substrate sheet 31 and a transferable layer disposed on one side surface of the substrate sheet 31. The transferable layer comprises a releasing layer 32, a receptor layer 33, and an adhesive layer 34. On the surface of the transferable layer, there is provided a minute unevenness configuration (or pattern).

As the method of providing the minute unevenness configuration to the surface of the transferable layer (the surface of the adhesive layer 34 in the embodiment shown in FIG. 6), there may be used a method wherein a filler is added to the coating liquid for forming the adhesive layer at the time of the formation of the adhesive layer. Specific examples of the filler may include; organic or inorganic fillers which are incompatible with an adhesive, such as titanium oxide, micro silica, teflon particles, silicon powder, colloidal silica, silicone rubber, calcium stearate, calcium carbonate, benzoguanamine resin particles, clay, barium sulfate, talc, megneisum hydroxide, zinc oxide, glass beads, alumina, mica, fluorinated graphite, styrene resin particles, vinylidene-acrylonitrile resin particles, urea-formalin resin particles, polymethacrylate resin particles, nylon resin particles, cellulose resin particles, wax particles, polyethylene resin particles, and potassium titanate particles. These resin particles may generally have a particle size of about 0.1 to 5 μm, and the addition amount thereof to the adhesive layer 34 may generally be about 20 to 100 wt. parts, with respect to 100 wt. parts of the adhesive resin. If the above particle size is too small or the addition amount is too small, it is not sufficient to form a good minute unevenness configuration. If the above particle size is too large, the surface smoothness of the transferable receptor layer is decreased. If the addition amount is too large, the adhesive property or film coating property of the adhesive layer 34 is undesirably decreased.

As another method of providing the minute unevenness configuration to the adhesive layer 34, there may be used a method wherein a foaming agent or bubbles are incorporated in the adhesive layer 34. The foaming agent to be used for such a purpose may be one which is capable of being decomposed at a high temperature to generate a gas such as oxygen, carbonic acid gas, and nitrogen. Specific examples of such a foaming agent may include: decomposition type foaming agents such as dinitropentamethylenetetramine, diazoaminobenzene, azobisisobutyronitrile, and azodicarboamide; and known foaming agent (or foaming material) such as so called micro balloon which may be prepared by microencapsulating a low boiling point liquid such as butane and pentane, with a resin such as polyvinylidene chloride and polyacrylonitrile. Further, it is also preferred to use a foaming material which is prepared by subjecting the above micro balloon to foaming operation in advance, or the micro balloon coated with (or covered with) a white pigment, etc..

As a further method, it is possible to use a method wherein the surface of the adhesive layer 34 once formed is subjected to enbossing by use of an enbossing roll, a shaping sheet, etc..

It is preferred that the minute unevenness configuration formed in the above manner is regulated corresponding to the surface roughness of the transfer receiving material. In general, however, it is preferred to use the minute unevenness configuration comparable to the above particle size. When the surface unevenness configuration is represented by an average surface roughness Ra, the Ra may generally be in the range of 0.01 to 30 μm, more preferably in the range of 0.1 to 5 μm.

Figure 7:
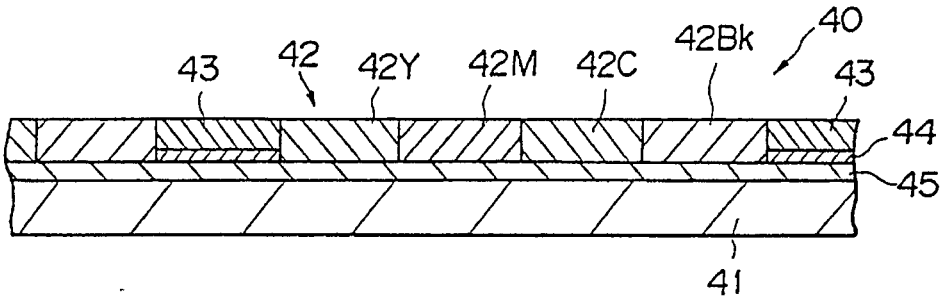
FIGS. 7 to 10 and 12 to 13 are schematic sectional views each showing the thermal transfer sheet according to an embodiment of the present invention.

FIG. 7 is a schematic sectional view showing an embodiment of the thermal transfer sheet according to the present invention. Referring to FIG. 7, the thermal transfer sheet 40 in this embodiment comprises a substrate sheet 41 and dye layers 42 of four colors (yellow layer 42Y, magenta layer 42M, cyan layer 42C, and black layer 42BK) and dye receptor layers 43 which are sequentially disposed on one side surface of the substrate sheet 41 by the medium of an adhesion promotion layer 45. Further, a release layer 44 is disposed between the dye receptor layer 43 and the adhesion promotion layer 45, so that the dye receptor layer 43 is releasable from the substrate sheet 41.

As the substrate sheet 41, there may be used the same substrate sheet as in the case of the receptor layer transfer sheet as described above. The adhesion promotion layer 45 to be formed on the surface of the substrate sheet 41 may be formed, e.g., by using the surface treating method as described in Japanese Laid Open Patent Application Nos. 204939/1987, 257844/1987, etc.. More specifically, it is possible to form such a layer by applying a certain coating liquid to the surface of the substrate sheet 41 by an appropriate application method and drying the resultant coating. The coating liquid usable for such a purpose may include: aqueous dispersions or solutions in an organic solvent comprising a resin of a heat curing type, a catalyst curing type, or an ionizing radiation curing type, such as crosslinked type polyurethane resin, acrylic type resin, melamine type resin and epoxy type resin. The thus formed adhesion promotion layer 45 may preferably have a thickness of 1 μm or below, more preferably 0.05 to 1.0 μm.

It is preferred to form the adhesion promotion layer 45 so that it may have a uniform thickness. For example, the adhesion promotion layer having a thickness of 1 μm or below in the form of a uniform thin film may be formed by disposing an adhesion promotion layer having a thickness of several microns on the substrate sheet 41 before the stretching (or orientation) treatment of the substrate sheet 41, and then subjecting the resultant substrate sheet to biaxial stretching treatment.

The dye layer 42 to be formed on the above substrate sheet 41 may be a layer wherein a dye is carried by an appropriate binder resin.

The dye to be used in this embodiment may be any of dyes usable in the conventional thermal transfer sheet, and is not particularly restricted. Preferred examples of such a dye may include; red dyes such as MS Red G, Macrolex Red Violet R, Ceres Red 7B, Samaron Red HBSL, Resolin Red F3BS; yellow dyes such as Horon Brilliant Yellow 6GL, PTY 52, Macrolex Yellow 6G; and blue dyes such as Kayaset Blue 714, Wacsorin Blue AP FW, Horon Brilliant Blue S-R, and MS Blue 100.

As the binder for carrying the above mentioned dye, any of known binders can be used. Preferred examples of the binder resin may include: cellulose resins such as ethylcellulose, hydroxyethylcellulose, ethylhydroxycellulose, hydroxypropylcellulose, methylcellulose, cellulose acetate, and cellulose acetate butyrate; vinyl type resins such as polyvinyl alcohol, polyvinyl acetate, polyvinyl butyral, polyvinyl acetal, polyvinyl pyrrolidone, and polyacrylamide; and polyester resin. Among these, cellulose type resins, acetal type resins, butyral type resins, and polyester type resins are particularly preferred in view of heat resistance, migration property of the dye, etc..

The dye layer 42 can further contain an additive selected from various additives known in the prior art, as desired.

Such a dye layer 42 may preferably be formed by dissolving or dispersing the above mentioned sublimable dye, binder resin and another optional components in an appropriate solvent to prepare a coating material or ink for forming the dye layer; sequentially applying the coating material(s) or ink(s) onto the above mentioned substrate film; and drying the resultant coating.

The thus formed dye layer 42 may generally have a thickness of about 0.2 to 5.0 μm, preferably about 0.4 to 2.0 μm. The sublimable dye content in the dye layer 42 may preferably be 5 to 90 wt. %, more preferably 10 to 70 wt. % based on the weight of the dye layer.

In this embodiment of the present invention, a release agent is added to the above ink for forming the dye layer at the time of the formation of the dye layer 42. In another embodiment, it is possible to form a release agent layer on the surface of the dye layer after the formation of the dye layer 42.

Preferred examples of the release agent to be used for such a purpose may include; silicone oil, phosphoric acid ester type surfactants, fluorine containing surfactants, etc.. Particularly preferred examples thereof may include silicone oil. Such a silicone oil may preferably be a modified silicone oil such as epoxy modified silicone oil, alkyl modified silicone oil, amino modified silicone oil, carboxyl modified silicone oil, alcohol modified silicone oil, fluorine modified silicone oil, alkylaralkylpolyether modified silicone oil, and epoxy-polyether modified silicone oil.

The release agent may be used either singly or as a combination of two or more species thereof. In a case where the release agent is added to the dye layer 42 the release agent may preferably be added to the dye layer 42 in an amount of 0.5 to 30 wt. parts with respect to 100 wt. parts of the resin constituting the dye layer 42. If such an addition amount is not in the above range, there can occur a problem such that thermal transfer sheet sticks to the dye receptor layer on a transfer receiving material or the printing sensitivity can be lowered, in some cases. When the above release agent is added to the dye layer 42, the release agent is bled or exuded to the surface of the dye layer 42 after the transfer operation so as to form thereon a release layer.

Instead of the use of the above release agent, there may also be used a binder which has been modified by using a releasing segment such as silicone compound, fluorine containing compound and long chain aliphatic compound, as a resin to be used for the formation of the dye layer.

When the release agent component is contained in the dye layer in the manner as described above, there may be provided a color image of high quality which is excellent in the transferability of the receptor layer, film cutting property, releasability at the time of image formation, adhesion property of the protection layer, etc..

The dye receptor layer 43 to be formed on the surface of the above substrate film 41 is one such that it may receive a sublimable dye migrating from (or transferring from) the thermal transfer sheet after it is transferred to an arbitrary (or optional) transfer receiving material, and may retain the thus formed image.

A plurality of the dye receptor layer 43 are sequentially formed on the above mentioned predetermined surface in relation with the above dye layer 42. The relation thereof with the dye layer is not particularly restricted. For example, specific examples of such a relation may include; a sequence of receptor layer→Y→M→C→Bk→receptor layer; a sequence of receptor layer→receptor layer→Y→M→C→Bk→receptor layer-receptor layer; a sequence of receptor layer→Y→receptor layer→M→receptor layer→C→receptor layer→Bk→receptor layer; etc...

Prior to the formation of the receptor layer 43, the release layer 44 is formed only on the side of the substrate sheet on which the receptor layer 43 is to be formed. The above release layer 44 should be formed from a material such that it provides an adhesion between the release layer 44 and the substrate sheet 41 which is larger than the adhesion between the release layer 44 and the receptor layer 43. Such a material may preferably comprise a resin which is not substantially melted with the heat applied thereto at the time of the transfer of the receptor layer and is less compatible with the resin constituting the receptor layer 43.

In the release layer 44, it is necessary to use a resin which provides little tackiness at a high temperature. For example, it is preferred to use a resin having a softening point of 130° C. or higher for such a purpose.

Preferred examples thereof may include: polyvinyl alcohol, polyvinyl acetal, polyvinyl butyral, polyvinyl pyrrolidone, polyamide, polyurethane, cellulose resin, polycarbonate, styrene resin, etc.. It is also possible to use an ionizing radiation curing resin which is capable of being crosslinked to be cured (or hardened) by electron beams or ultraviolet rays. The release layer comprising such a resin strongly adheres to the substrate film and is not melted at a temperature at the time of the transfer operation. Accordingly, the receptor layer 43 can easily be peeled from the release layer 44.

As a matter of course, silicone resins, fluorine containing resins, etc., are well known as resins excellent in releasability. However, such a resin is used for the above purpose, it provides too excessive releasability and does not provide good film cutting at the time of the transfer operation.

The release layer 44 may be formed in the same manner as in the case of the receptor layer 43 as described hereinbelow. It is sufficient that the release layer has a thickness of about 0.5 to 5 μm.

It is also possible to add a metal chelate or matting agent to the release layer 44 so as to regulate the adhesion of the release layer 44 with the substrate sheet 41 or the receptor layer 43 and provide a matted receptor layer.

The dye receptor layer 43 may be formed from a resin having a good dyeing property with respect to the sublimable dye. Specific examples of such a resin may include resins to be used for the formation of the receptor layer constituting the receptor layer transfer sheet as described hereinabove. It is preferred to use a release agent in combination at the time of the formation of the receptor layer 43, in the same manner as in the case of the dye receptor layer constituting the receptor layer transfer sheet. It is also possible to add a pigment, a filler, etc., selected from various species thereof, to the receptor layer 43. These release agent, pigment and filler to be used for such a purpose may be the same as in the case of the formation of the receptor layer constituting the receptor layer transfer sheet.

The receptor layer 43 may be formed by a method according to the method for forming the receptor layer constituting the receptor layer transfer sheet as described above. It is also possible to form an intermediate layer or adhesive layer on the surface of the receptor layer 43, in the same manner as in the case of the receptor layer transfer sheet as described above.

In the thus formed thermal transfer sheet 40, the adhesion between the dye layer 42 and the substrate sheet 41 is strong and the adhesion between the receptor layer 43 and the substrate sheet 41 may be in an appropriate range.

Figure 8:
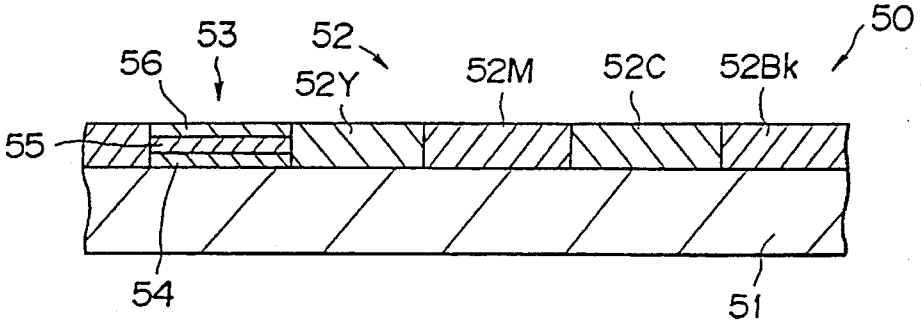

FIG. 8 is a schematic sectional view showing an embodiment of the thermal transfer sheet according to the present invention. Referring to FIG. 8, the thermal transfer sheet 50 in this embodiment comprises a substrate sheet 51 and dye layers 52 of four colors (yellow layer 52Y, magenta layer 52M, cyan layer 52C, and black layer 52Bk) and a transferable layer 53 comprising a dye receptor layer 54, an intermediate layer 55 and an adhesive layer 56 which are sequentially disposed on one side surface of the substrate sheet 51.

In the above thermal transfer sheet 50 is characterized in that at least one layer selected from the receptor layer 54, adhesive layer 56 and intermediate layer 55 contains a white pigment, a fluorescent bringhtening agent (or fluorescent brightener) and/or bubbles. In order to incorporate such a white pigment, etc., to the above layer, it is possible to incorporate the white pigment, etc., to a coating liquid to be used for forming each of the above layers.

The white pigment has an object of improving the whiteness and the hinding power of the dye receptor layer so as to prevent the background color of an image receiving sheet from affecting the resultant image. Specific examples of such a white pigment may include white pigments such as titanium oxide, zinc oxide, kaolin clay, calcium carbonate, and silica fine powder. While the addition amount of the white pigment may vary depending on the kind of the pigment to be used for such a purpose, the addition amount may generally be about 1 to 100 wt. parts with respect to 100 wt. parts of the resin constituting the receptor layer.

The fluorescent brightening agent has a function of removing the yellowish hue of the receptor layer so as to improve the whiteness thereof. Specific examples thereof may include known fluorescent brightening agents such as those of stilbene type, diaminodiphenyl type, oxazole type, imidazole type, thiazole type, courmarin (or coumalin) type, naphthalimide type, thiophene type, etc.. The fluorescent brightening agent may show a sufficient effect at an extremely low concentration, e.g., 0.01 to 5 wt. %, when dissolved in the resin to be used for the receptor layer. The foaming agent to be used for incorporating the bubbles may be any of various foaming agents to be used for the above receptor layer transfer sheet. In a most preferred embodiment of the thermal transfer sheet 50, the intermediate layer 55 and adhesive layer 56 are formed on the receptor layer 54, the receptor layer 54 contains the fluorescent brightening agent, the intermediate layer 55 contains the white pigment and the adhesive layer 56 contains the bubbles.

As described above, when the group consisting of at least one species selected from the white pigment, fluorescent brightening agent and bubbles is contained in at least one layer selected from the receptor layer 54, the intermediate layer 55 and the adhesive layer 56 of the thermal transfer sheet 50, color images of high quality may be formed regardless of the kind of the image receiving sheet.

Figure 9:
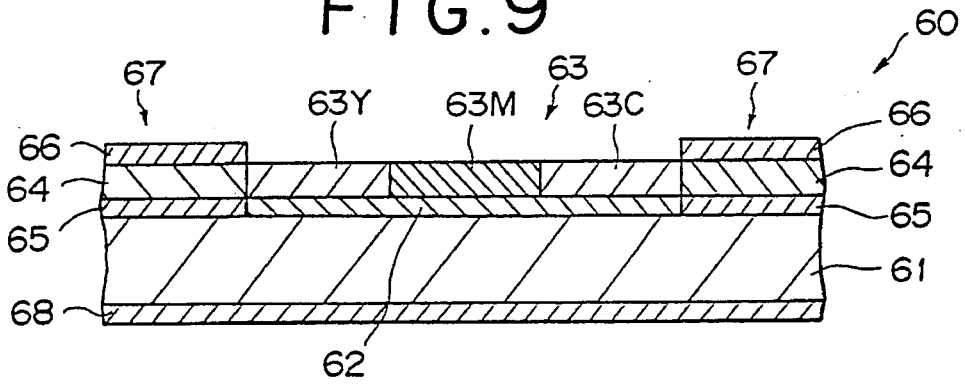
Figure 10:
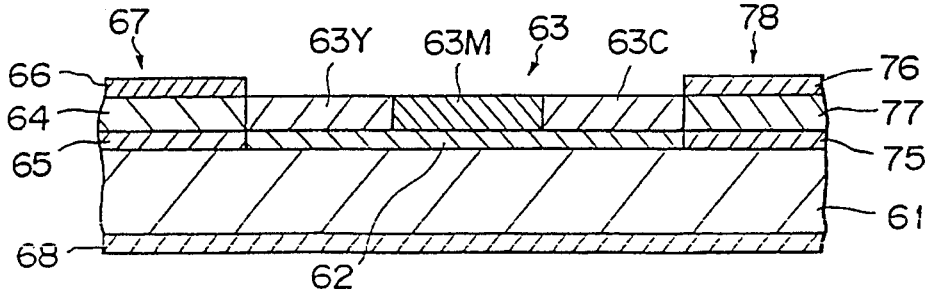

FIGS. 9 and 10 are schematic views each showing another embodiment of the thermal transfer sheet according to the present invention. Referring to FIG. 9, the thermal transfer sheet 60 in this embodiment comprises a substrate sheet 61 and dye layers 63 of three colors (yellow layer 63Y, magenta layer 63M, and cyan layer 63C) and a transferable layer 67 comprising a release layer 65, a dye receptor layer 64 and an adhesive layer 66 which are sequentially disposed on one surface side of the substrate sheet 61. The dye layer 63 is disposed on the surface of the substrate sheet 61 by the medium of an adhesive layer 62. Further, a back coating layer 68 is disposed on the other surface side of the substrate sheet 61.

In the thermal transfer sheet 70 shown in FIG. 10, a protection layer 78 comprising a release layer 75, a transfer protection layer 77 and an adhesive layer 76 is disposed between the dye layer 63*c* and the transferable layer 67 constituting the thermal transfer sheet 60 as shown in FIG. 9. In other words, in the thermal transfer sheet 70, there are disposed the respective layers in the sequence of the transferable layer 67, the yellow layer 63Y, the magenta layer 63M, the cyan layer 63C and the protection layer 78.

In the thermal transfer sheets 60 and 70, the total thickness of the transferable layer 67 may be 3 to 40 μm. In a case where the thickness of the transferable layer 67 is limited in the above manner, the occurrence of creases or wrinkles is prevented, even when the thermal transfer sheets 60 or 70 is wound up into a roll. When the adhesive layer 62 is formed only the region wherein the dye layer 63 is to be formed, there may be provided a thermal transfer sheet wherein the adhesion property of the dye layer 63 is good and the releasability of the transferable layer 67 and the protection layer 78 is also good.

As the material constituting the transfer protection layer 77, there may be used any of various resins which are excellent in wear resistance, chemical resistance, transparency, hardness, etc.. Specific examples of such a resin may include: polyester resin, polystyrene resin, acrylic resin, polyurethane resin, acrylic urethane resin, silicone modified derivatives of these resins, and mixtures of these resins. The transfer protection layer 77 may preferably have a thickness of about 0.1 to 20 μm. The transfer protection layer 77 may also be formed from a resin which is substantially the same as that constituting the receptor layer 64.

Figure 11:
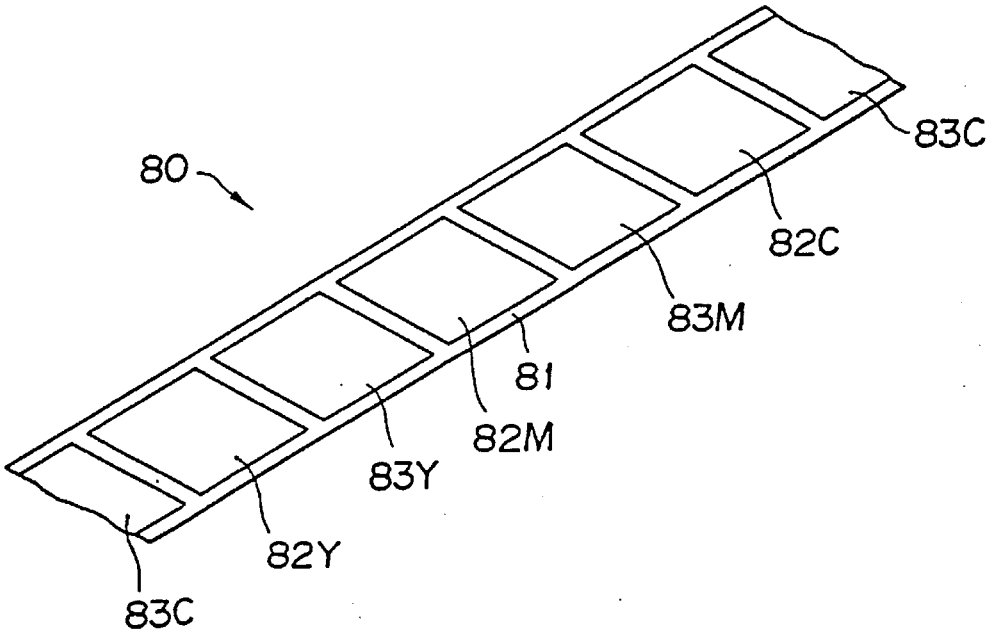
FIG. 11 is a schematic perspective view showing the thermal transfer sheet according to an embodiment of the present invention.

FIG. 11 is a perspective view showing a further embodiment of the thermal transfer sheet according to the present invention. Referring to FIG. 11, the thermal transfer sheet 80 comprises a substrate sheet 81 and a receptor layer for yellow color 82Y, a yellow dye layer 83Y, a receptor layer for magenta color 82M, a magenta dye layer 83M, a receptor layer for cyan color 82C, and a cyan dye layer 83C (and a receptor layer for black color and a black dye layer, as desired) disposed on one surface side of the substrate sheet 81. In such a case, the receptor layer 82Y for yellow color may be formed from a resin for a receptor layer which is so selected that it shows excellent dyeing property and storability (migration prevention property) with respect to the yellow dye. Similarly, the other receptor layers are formed from resins which are so selected that they are suitable for magenta dye and cyan dye, respectively.

When a color image is formed by using the thermal transfer sheet 80 according to the present embodiment as described above, the receptor layer 82Y for yellow color is first transferred to a transfer receiving material, and immediately thereafter, the yellow dye layer 83Y is transferred to the resultant receptor layer. Then, transfer operations are similarly effected with respect to the magenta and cyan colors. As a result, according to this embodiment, abnormal transfer is prevented as described hereinabove. Further, since the dyes of the respective colors are transferred to receptor layers each of which is suitable for the corresponding dye, the transferred dye does not migrate in the receptor layer. Accordingly, a problem such as blurring does not occur in the resultant color image even when the thus formed image is stored for a long period of time.

Figure 12:
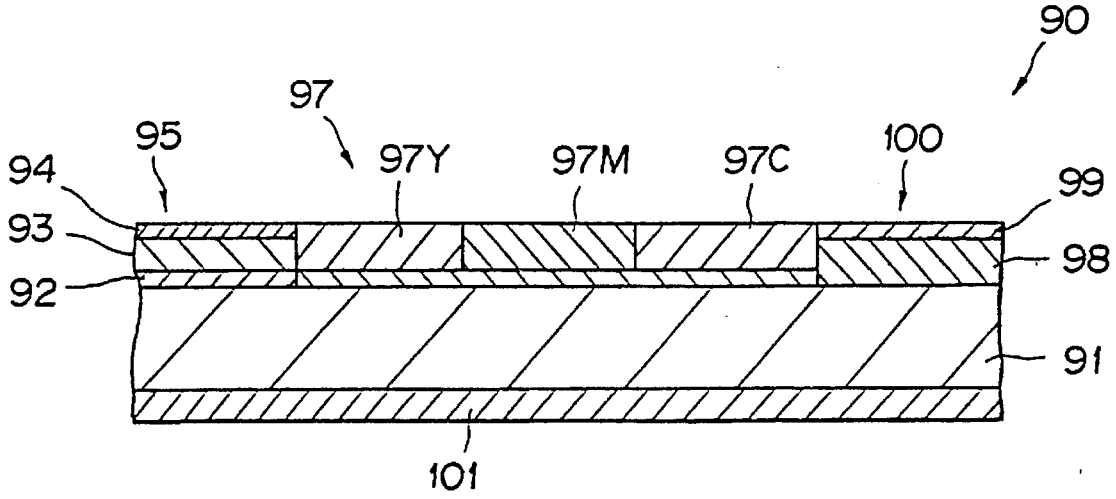

FIG. 12 is a schematic sectional view showing a further embodiment of the thermal transfer sheet according to the present invention. Referring to FIG. 12, the thermal transfer sheet 90 in this embodiment comprises a substrate sheet 91; and dye layers 97 of three colors (yellow layer 97Y, magenta layer 97M, cyan layer 97C); a transferable layer 95; and a protection layer 100 comprising a transferable protection layer 98 and an adhesive layer 99 which are sequentially disposed on one side surface of the substrate sheet 91. The transferable layer 95 comprises a dye receptor layer 92, an intermediate layer 93 and an adhesive layer 99. The dye layer 97 is disposed on the surface of the substrate sheet 91 by the medium of an adhesive layer 96. The intermediate layer 93 of the thermal transfer sheet 90 may be formed from a resin at least a part of which is crosslinked, as in the above case of the intermediate layer of the receptor layer transfer sheet.

The intermediate layer 93 of the thermal transfer sheet 90 may be formed from a resin having a glass transition point (Tg) of 10° C. or below. In such a case, the intermediate layer 93 may preferably have a tensile elongation at break in the range of 50 to 1000%. On the back side of the substrate sheet, there is provided a back coating layer 101.

Figure 13:
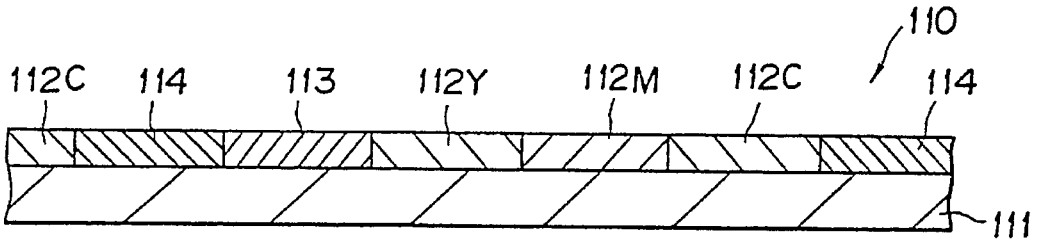

FIG. 13 is a schematic sectional view showing an embodiment of the thermal transfer sheet according to the present invention. Referring to FIG. 13, the thermal transfer sheet 120 in this embodiment comprises a substrate sheet 111 and dye layers 112 of three colors (yellow layer 112Y, magenta layer 112M, and cyan layer 112C), a dye receptor layer 113 and a transferable protection layer 114 which are sequentially disposed on one surface side of the substrate sheet 111.

The thermal transfer sheet 110 is characterized in that the dye receptor layer 113 is caused to be white and opaque. More specifically, the dye receptor layer 113 is opaque to such an extent that it may provide a substantial difference in light transmissivity with the dye layer 112 and the transfer protection layer 114. In such a case, the white pigment may preferably be added to the receptor layer 113 in an amount of 1 to 200 wt. parts with respect to 100 wt. parts of the resin constituting the receptor layer 113.

Further, it is preferred to dispose an adhesive layer on the surface of the above receptor layer 113 so as to improve the transferability thereof. It is also possible to dispose an intermediate layer between the above receptor layer 113 and the above adhesive layer.

It is also possible to add the white pigment to the above adhesive layer and/or the intermediate layer, and in such a case, the receptor layer 113 does not necessarily contain the white pigment.

Next, there will be described a thermal transfer method using the thermal transfer sheet 110 shown in FIG. 13, with reference to FIGS. 14 and 15.

Figure 14:
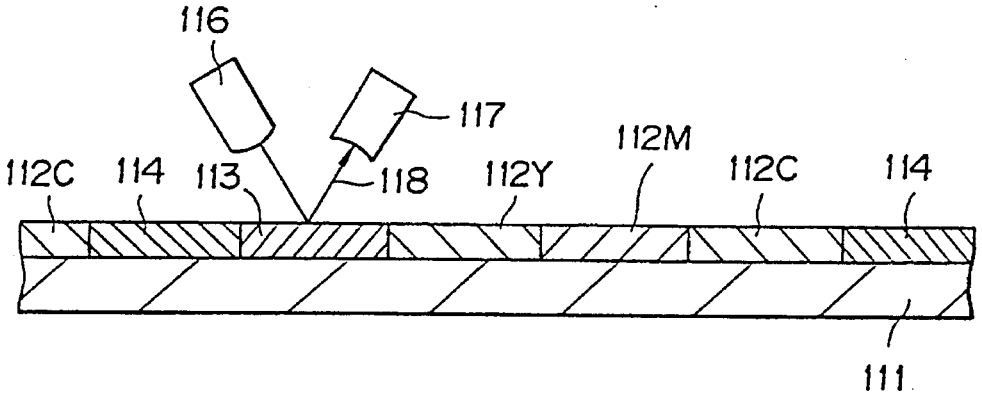
FIGS. 14 and 15 are schematic sectional views showing the thermal transfer method according to the present invention.

Referring to FIG. 14, when the thermal transfer sheet shown in FIG. 13 is loaded to a printer as shown in FIG. 14 which has a floodlight device 116 and a light receiving sensor 117 on one side so as to effect thermal transfer operation, a detection light 118 ejected from the floodlight device 116 is reflected by a portion of the receptor layer 113, and the resultant reflection light is received by the light receiving sensor 117. Since the position other than the receptor layer, i.e., the dye layer 112 and the protection layer 114 are substantially light transmissive (or transparent), the detection light 118 is not detected by the light receiving sensor 117 with respect to these layers. Since the dye layers are formed according to a predetermined sequence of, e.g., yellow, magenta and cyan, when the light receiving sensor 117 detects the detection light, the printer recognizes the presence of the dye receptor layer 113. Accordingly, in such a case, the printer can continuously and sequentially subject the layers of the yellow, magenta and cyan colors (and the protection layer) to the printing operation. Then, the printer again detects the receptor layer and the above steps are repeated.

Figure 15:
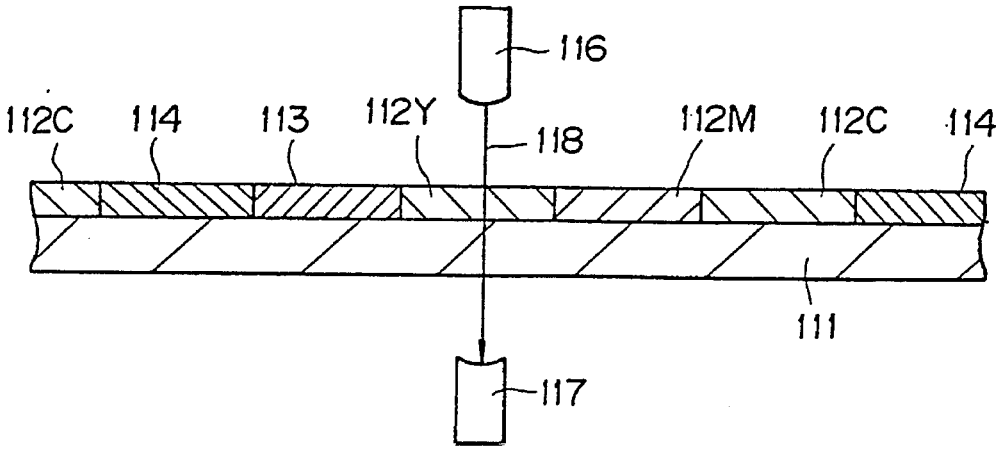

FIG. 15 is a view showing another preferred embodiment wherein the floodlight device 116 and the light receiving sensor 117 are disposed opposite to each other by the medium of the thermal transfer sheet 110. In this embodiment, the same operations as described above with reference to FIG. 14 are effected except that the receptor layer 113 is detected when the light receiving sensor 117 does not detects the detection light 118, whereby similar effects are provided.

The apparatus to be used in the present invention is the same as those known in the prior art except that the thermal transfer sheet to be loaded thereto has the specific structure as described hereinabove. For example, such an apparatus may be a thermal transfer apparatus which comprises an image receiving sheet, means for conveying the image receiving sheet, means for conveying the thermal transfer sheet, means for applying heat to the thermal transfer sheet, and detection means comprising the floodlight device and the light receiving device.

The transfer receiving material to which the transferable layer comprising the receptor layer is to be transferred by using the receptor layer transfer sheet as described hereinabove should not particularly be restricted.

For example, specific examples of such a transfer receiving material may include any of various sheets such as plain paper, wood free paper, tracing paper, and plastic film. The shape or form of the transfer receiving material may be any of various forms such as cards, post cards, passports, letter papers, writing papers, notepapers, and catalogs. Particularly, the present invention is applicable to plan papers or rough papers having rough surface texture.

The receptor layer may be transferred by use of any of various heating and pressing means which are capable of heating the receptor layer or adhesive layer so as to activate these layers. Specific examples of such heating and pressing means may include: general printers equipped with a thermal head for thermal transfer operation, hot stampers for transferable film or foil, and hot rollers.

When thermal transfer operation is effected by using the transfer receiving material to which the receptor layer has been transferred, the means for applying heat energy to be used for the thermal transfer operation may be any of various known heat energy application means. For example, when a recording time is controlled by using a recording apparatus such as a thermal printer (e.g., Video printer VY 100, mfd. by Hitachi K.K.), so as to provide a heat energy of about 5 to 100 mJ/mm$^2$, a desired image may be formed.

Hereinbelow, the present invention will be described in more detail with reference to Examples and Comparative Examples. In the description appearing hereinafter, part(s) and % are part(s) by weight and wt. %, respectively, unless otherwise noted specifically.

EXAMPLE A1

A coating liquid for a receptor layer having the following composition was applied onto a surface of a 25 μm thick polyester film (tradename: Lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Then, a coating liquid for an intermediate layer having the following composition was applied onto the surface of the above receptor layer so as to provide a coating amount of 5 g/m$^2$ (after drying) and then dried in the same manner as described above, whereby an intermedite layer was formed.

Thereafter, a solution of an adhesive agent having the following composition was applied onto the above intermediate layer so as to provide a coating amount of 2 g/m$^2$ (after drying) and then dried in the same manner as described above, whereby an adhesive layer was formed.

Then, the resultant adhesive layer was subjected to foaming treatment at 120° C. for 2 min., whereby a receptor layer transfer sheet according to the present invention was obtained.

| Composition of coating liquid for receptor layer | |
|---|---|
| Vinyl chloride vinyl acetate copoplymer (#1000A, mfd. by Denki Kagaku Kogyo K.K.) | 100 parts |
| Amino modified silicone (X-22-343, mfd. by Shinetsu Kagaku Kogyo K.K.) | 5 parts |
| Epoxy modified silicone (KF-393, mfd. by Shinetsu Kagaku Kogyo K.K.) | 5 parts |
| Methyl ethyl ketone/toluene (wt. ratio = 1/1) | 500 parts |
| **Composition of coating liquid for intermediate layer** | |
| Urethane type resin (XE-727A-1, mfd. by Takeda Yakuhin Kogyo K.K.) | 100 parts |
| Foaming agent (F-30D, mfd. by Matsumoto Yushi Seiyaku K.K.) | 10 parts |
| Isopropylalcohol/toluene (wt. ratio = 1/1) | 500 parts |
| **Composition of coating liquid for adhesive layer** | |
| Ethylene-vinyl acetate copolymer type heat sealing agent (AD-37P295, mfd. by Toyo Morton K.K.) | 100 parts |
| Pure water | 100 parts |

EXAMPLE A2

A receptor layer transfer sheet according to the present invention was prepared in the same manner as in Example A1, except that the foaming agent was incorporated not in the intermediate layer but in the adhesive layer.

EXAMPLE A3

A receptor layer transfer sheet according to the present invention was prepared in the same manner as in Example A1, except that foaming agent (F-80D, mfd. by Matsumoto Yushi Seiyaku K.K.) was used instead of the foaming agent used in Example A1.

COMPARATIVE EXAMPLE A1

A receptor layer transfer sheet of Comparative Example was prepared in the same manner as in Example A1, except that the foaming agent was not used.

Separately, an ink for a dye layer having the following composition was prepared and applied onto a 6 μm thick polyethylene terephthalate film of which back surface had been subjected to heat resistance imparting treatment, by means of a wire bar coater so as to provide a coating amount of 1.0 g/m$^2$ (after drying) and then dried. Further, few drops of a silicone oil (X-41. 4003A, mfd. by Shinetsu Silicone K.K.) were dripped onto the back surface by means of a dropping pipette and the dripped silicone oil was spread over the entire surface to effect back surface coating treatment, whereby a thermal tranfer sheet was obtained.

| Ink composition of dye layer | |
|---|---|
| Disperse dye (Kayaset Blue 714, mfd. by Nihon Kayaku K.K.) | 4.0 parts |
| Ethyl hdroxycellulose (mfd. by Hercules Co.) | 5.0 parts |
| Methyl ethyl ketone/toluene (wt. ratio = 1/1) | 80.0 parts |
| Dioxane | 10.0 parts |

The receptor layer transfer sheet as described above was superposed on plain paper and a receptor layer was transferred to the plain paper by means of a hot roller. Then, the thermal transfer sheet as described above was superposed on the plain paper so that the thermal transfer sheet contacted the surface of the above receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 1.

TABLE 1

| | Image quality |
|---|---|
| Example A1 | White dropout or image defect was not observed in the image. Resolution was high. |
| Example A2 | White dropout or image defect was not observed in the image. Resolution was high. |
| Example A3 | White dropout or image defect was not observed in the image. Resolution was high. |
| Comparative Example A1 | White dropout and image defect were observed in the image. Resolution was low. |

EXAMPLE B1

A coating liquid for a receptor layer having the following composition was applied onto a surface of a 9 μm thick polyester film (tradename; Lumirror, mfd. by Toray K.K.) by means of a bar coater so as to provide a coating amount of 5.0 g/m$^2$ (after drying), and the resultant coating was dried by means of a dryer, thereby to form a dye receptor layer.

Thereafter, a solution of an adhesive agent having the following composition was applied onto the above receptor layer so as to provide a coating amount of 2 g/m$^2$ (after drying) and then dried in the same manner as described above, to form an adhesive layer, wehreby a receptor layer transfer sheet according to the present invention was obtained.

| Composition of coating liquid for receptor layer | |
|---|---|
| Vinyl chloride/vinyl acetate copoplymer (#1000AS. average degree of polymerization = 320, mfd. by Denki Kagaku Kogyo K.K.) | 100 parts |
| Amino modified silicone (X-22-343, mfd. by Shinetsu Kagaku Kogyo K.K.) | 5 parts |
| Epoxy modified silicone (KF-393, mfd. by Shinetsu Kagaku Kogyo K.K.) | 5 parts |
| Methylethylketone/toluene (wt. ratio = 1/1) | 500 parts |
| **Composition of coating liquid for adhesive layer** | |
| Ethylene-vinyl acetate copolymer type heat sealing agent (AD-37P295, mfd. by Toyo Morton K.K.) | 100 parts |
| Pure water | 100 parts |

EXAMPLE B2

A receptor layer transfer sheet according to the present invention was prepared in the same manner as in Example B1, except that a vinyl chloride/vinyl acetate copolymer (#1000D, average degree of polymerization=400, mfd. by Denki Kagaku Kogyo K.K.) was used as the base resin instead of that used in Example B1.

EXAMPLE B3

A receptor layer transfer sheet according to the present invention was prepared in the same manner as in Example B1, except that a vinyl chloride/vinyl acetate copolymer (VYHD, average degree of polymerization=340, mfd. by Rohm & Haas Co.) was used as the base resin instead of that used in Example B1.

COMPARATIVE EXAMPLE B1

A receptor layer transfer sheet of Comparative Example was prepared in the same manner as in Example B1, except that a vinyl chloride/vinyl acetate copolymer (#1000A, average degree of polymerization=430, mfd. by Denki Kagaku Kogyo K.K.) was used as the base resin instead of that used in Example B1.

COMPARATIVE EXAMPLE B2

A receptor layer transfer sheet of Comparative Example was prepared in the same manner as in Example B1, except that a vinyl chloride/vinyl acetate copolymer (VYNS, average degree of polymerization=700, mfd. by Rohm & Haas Co.) was used as the base resin instead of that used in Example B1.

USAGE EXAMPLE

A rectangular receptor layer was transferred to an upper central portion of a post card by means of a thermal head by using each of the above receptor layer transfer sheets of Examples and Comparative Example. Then, the edge of the resultant transferred layer was observed with an optical microscope.

The thus obtained results were shown in the following Table 2.

TABLE 2

| Receptor layer transfer sheet | Film cutting property |
|---|---|
| Example B1 | linear |
| Example B2 | substantially linear |
| Example B3 | linear |
| Comparative Example B1 | indented |
| Comparative Example B2 | indented |

EXAMPLE C1

Coating liquids for a receptor layer, an intermadiate layer (a releasing agent barrier layer) and an adhesive layer having the following compositions were respectively applied onto one side surface of a 6.0 μm thick polyethylene terephthalate film (tradename; Lumirror, mfd. by Toray K.K.) by means of a bar coater so as to provide coating amounts of 4 g/m$^2$, 2.1 g/m$^2$ and 5 g/m$^2$, (after drying), respectively, and the resultant coatings were dried at an appropriate temperature and for an appropriate period of time, thereby to obtain a receptor layer transfer sheet according to the present invention.

| Coating liquid for receptor layer | |
|---|---|
| Vinyl chloride/vinyl acetate copoplymer (#1000A, mfd. by Denki Kagaku Kogyo K.K.) | 100 parts |
| Amino modified silicone (KF-393, mfd. by Shinetsu Kagaku Kogyo K.K.) | 5 parts |
| Epoxy modified silicone (KS-343, mfd. by Shinetsu Kagaku Kogyo K.K.) | 5 parts |
| Methyl ethyl ketone/toluene (wt. ratio = 1/1) | 500 parts |
| **Coating liquid for releasing agent barrier layer** | |
| Nylon resin (FS-175, mfd. by Toa Gosei K.K.) | 100 parts |
| Denatured ethanol | 30 parts |
| **Coating liquid for adhesive layer** | |
| Urethane resin/isocyanate (Takelack A-310/A-3, mfd. by Takeda Yakuhin Kogyo K.K.) | 100 parts |
| Ethyl acetate | 50 parts |

EXAMPLE C2

A receptor layer transfer sheet was obtained in the same manner as in Example C1 except that the following coating liquid was used as a coating liquid for the release agent barrier layer instead of that used in Example C1.

| Coating liquid for release agent barrier layer | |
|---|---|
| Vinyl chloride/vinyl acetate copolymer (#1000A, mfd. by Denki Kagaku Kogyo K.K.) | 100 parts |
| MEK/Toluene | 700 parts |

EXAMPLE C3

A receptor layer transfer sheet was obtained in the same manner as in Example C1 except that the following coating liquids were used as coating liquids for the respective layers instead of these used in Example C1.

| Coating-liquid for receptor layer | |
|---|---|
| Vinyl chloride/vinyl acetate copolymer (#1000A, mfd. by Denki Kagaku Kogyo K.K.) | 100 parts |
| Amino modified silicone (KF-393, mfd. by Shinetsu Kagaku Kogyo K.K.) | 5 parts |
| Epoxy modified silicone (KS-343, mfd. by Shinetsu Kagaku Kogyo K.K.) | 5 parts |
| Fluorescent brightening agent (Yubitex OB, mfd. by Ciba Geigy Co.) | 1 parts |
| Methyl ethyl ketone/toluene (wt. ratio = 1/1) | 500 parts |
| **Coating liquid for releasing agent barrier layer** | |
| Nylon resin (FS-175, mfd. by Toa Gosei K.K.) | 100 parts |
| Denatured ethanol | 30 parts |
| **Coating liquid for adhesive agent layer** | |
| Nylon resin (1163V, mfd. by Toa Gosei K.K.), | 100 parts |
| Titanium oxide | 20 parts |
| Toluene | 700 parts |

COMPARATIVE EXAMPLE C1

A receptor layer transfer sheet was obtained in the same manner as in Example C1 except that the barrier layer was not formed.

COMPARATIVE EXAMPLE C2

A receptor layer transfer sheet was obtained in the same manner as in Example C2 except that the barrier layer was not formed.

The above receptor layer transfer sheets of Examples and Comparative Examples were left standing for 72 hours under the condition of 40° C. and 90% RH. Then, a receptor layer was transferred to plain paper by means of a hot roller by using each of the above receptor layer transfer sheets. Thereafter, a full color gradation image was formed on the resultant receptor layer by means of a subliming type thermal transfer printer (Video Printer VY-100, mfd. by Hitachi Seisakusho K.K.). In the case of the receptor layer formed by the receptor layer transfer sheet according to each of Examples, there was not posed a problem of release between the image receiving sheet and the receptor layer. In the case of the receptor layer transfer sheet of Comparative Examples, abnormal transfer was caused and good images could not be formed.

EXAMPLE D1

A coating liquid for a receptor layer having the following composition was applied onto a surface of a 25 μm thick polyester film (tradename: lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Then, a coating liquid for an intermediate layer having the following composition was applied onto the surface of the above receptor layer so as to provide a coating amount of 5 g/m$^2$ (after drying) and then dried in the same manner as described above, whereby an intermediate layer was formed. Thereafter, a solution of an adhesive agent having the following composition was applied onto the above intermediate layer so as to provide a coating amount of 2 g/m$^2$ (after drying) and then dried in the same manner as described above, wehreby an adhesive layer was formed.

Then, the resultant adhesive layer was subjected to foaming treatment at 120° C. for 2 min., whereby a receptor layer transfer sheet according to the present invention was obtained.

| Composition of coating liquid for receptor layer | |
|---|---|
| Vinyl chloride/vinyl acetate copolymer (VYHD, mfd. by Union Carbide Co.) | 100 parts |
| Epoxy modified silicone (KF-393, mfd. by Shinetsu Kagaku Kogyo K.K.) | 1 part |
| Amino modified silicone (KS-343, mfd. by Shinetsu Kagaku Kogyo K.K.) | 1 part |
| Methyl ethyl ketone/toluene (wt. ratio = 1/1) | 500 parts |
| **Composition of coating liquid for intermediate layer** | |
| Acrylpolyol resin (Thermorack U230, mfd. by Soken Kagaku K.K.) | 100 parts |
| Titanium Oxide (TCA-888, mfd. by Tohchem Product K.K.) | 50 part |
| Polyisocyanate resin (Takenate D-102, mfd. by Takeda Yakuhin Kogyo K.K.) | 10 part |
| Methyl ethyl ketone/toluene (wt. ratio = 1/1) | 300 parts |
| **Composition of coating liquid for adhesive layer** | |
| Polymethyl methacrylate resin (BR-106, mfd. by Mitsubishi Rayon K.K.) | 100 parts |
| Titanium oxide (TCA-888, mfd. by Tochem Products K.K.) | 100 parts |
| Heat foaming type microcapsule (F-30D, mfd. by Matsumoto Yushi Seiyaku K.K.) | 10 parts |
| Isopropylalcohol/toluene (wt. ratio = 1/1) | 500 parts |

EXAMPLE D2

A receptor layer transfer sheet according to the present invention was prepared in the same manner as in Example D1, except that 20 parts of microcapsules coated with titanium (F 30D/TiO2, mfd. by Matsumoto Yushi Seiyaku K.K.) were incorporated in the adhesive layer instead of the titanium oxide and microcapsules used in Example D1.

COMPARATIVE EXAMPLE D1

A receptor layer transfer sheet was prepared in the same manner as in Example D1, except that the microcapsules were not used in the adhesive layer.

COMPARATIVE EXAMPLE D2

A receptor layer transfer sheet was prepared in the same manner as in Example D1, except that the titanium oxide was not used in the adhesive layer.

COMPARATIVE EXAMPLE D3

A receptor layer transfer sheet was prepared in the same manner as in Example D1, except that the microcapsules were used alone in the adhesive layer.

The receptor layer transfer sheet as described above was superposed on plain paper and a receptor layer was transferred to the plain paper by means of a hot roller. Then, the same thermal transfer sheet is that used in Example A was superposed on the plain paper so that the thermal transfer sheet contacted the surface of the above transfered receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 3.

TABLE 3

| | Image clearness | White dropout in image |
|---|---|---|
| Example D1 | The receptor layer was white and the image was clear. | No white dropout was produced in the resultant image. |
| Example D2 | The receptor layer was white and the image was clear. | No white dropout was produced in the resultant image. |
| Comparative Example D1 | The receptor layer was white and the image was clear. | White dropout was produced in the resultant image. |
| Comparative Example D2 | Whiteness was insufficient and the image was not clear. | White dropout was produced in the image. |
| Comparative Example D3 | Whiteness was insufficient and the image was not clear. | No white dropout was produced in the image. |

EXAMPLES E1 TO E6

A coating liquid for a receptor layer having the following composition was applied onto a surface of a 25 μm thick polyester film (tradename: Lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Thereafter, a solution of an adhesive agent having the following composition was applied onto the above receptor layer so as to provide a coating amount of 2 g/m$^2$ (after drying) and then dried in the same manenr as described above to form an adhesive layer, whereby a receptor layer transfer sheet according to the present invention was obtained.

| Composition of coating liquid for receptor layer | |
|---|---|
| Vinyl chloride/vinyl acetate copolymer (1000GKT, mfd. by Denki Kagaku Kogyo K.K.) | 100 parts |
| Fibers shown in the following Table 4 (whisker) | X parts |
| Amino modified silicone (X-22-343, mfd. by Shinetsu Kagaku Kogyo K.K.) | 3 parts |
| Epoxy modified silicone (KF-393, mfd. by Shinetsu Kagaku Kogyo K.K.) | 3 parts |
| Methyl ethyl ketone/toluene (wt. ratio = 1/1) | 500 parts |
| **Composition of coating liquid for adhesive layer** | |
| Polymethyl methacrylate resin (BR-106, mfd. by Mitsubishi Rayon K.K.) | 100 parts |
| Fibers shown in the following Table 4 (whisker) | Y parts |
| Methylethylketone/toluene (wt. ratio = 1/1) | 400 parts |

TABLE 4

| | Fibers and X in coating, liquid for receptor layer | Fibers and Y in coating liquire for adhesive layer |
|---|---|---|
| Example E1 | Potassium titanate whisker (Tismo D, mfd. by Ohtsuka Kagaku) 40 parts | Not used |
| Example E2 | Potassium titanate whisker (Tofica Y, mfd. by Ohtsuka Kagaku) 40 parts | Not used |
| Example E3 | Not used | Potassium titanate whisker (Tismo D, mfd. by Ohtsuka Kagaku) 40 parts |
| Example E4 | Not used | Potassium titanate whisker (Tofica Y, mfd. by Ohtsuka Kagaku) 40 parts |
| Example E5 | Not used | Silicon nitride fiber (UBE SN-W, mfd. by Ube Kosan) 40 parts |
| Example E6 | Not used | Silicon carbide fiber (Tokawhisker, mfd. by Tokai Carbon) 40 parts |
| Comparative Example E1 | Not used | Not used |

The receptor layer transfer sheet as described above was superposed on a post card and a receptor layer was transferred to the post card by means of a hot roller. Then, the same thermal transfer sheet as that used in Example A was superposed on the plain paper so that the thermal transfer sheet contacted the surface of the above receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 5.

TABLE 5

| | Image clearness | White dropout in image |
|---|---|---|
| Example E1 | Good | No white dropout or image defect was produced in the resultant image. |
| Example E2 | Good | No white dropout or image defect was produced in the resultant image. |
| Example E3 | Good | No white dropout or image defect was produced in the resultant image. |
| Example E4 | Good | No white dropout or image defect was produced in the resultant image. |
| Example E5 | Good | No white dropout or image defect was produced in the resultant image. |
| Example E6 | Good | No white dropout or image defect was produced in the resultant image. |
| Comparative Example E1 | Good | White dropout and image defect were produced in the resultant image. |

EXAMPLE F1

A coating liquid for a receptor layer having the following composition was applied onto a surface of a 25 μm thick polyester film (tradename: Lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Then, a coating liquid for an intermediate layer having the following composition was applied onto the surface of the above receptor layer so as to provide a coating amount of 2 g/m$^2$ (after drying) and then dried in the same manner as described above, whereby an intermediate layer was formed. Thereafter, a solution of an adhesive agent having the following composition was applied onto the above intermediate layer so as to provide a coating amount of 2 g/m$^2$ (after drying) and then dried in the same manner as described above, whereby an adhesive layer was formed.

Then, the resultant product was subjected to crosslinking treatment at 120° C. for 10 min., whereby a receptor layer transfer sheet according to the present invention was obtained.

| Composition of coating liquid for receptor layer | |
|---|---|
| Vinyl chloride/vinyl acetate copolymer (VYHD, mfd. by Union Carbide Co.) | 100 parts |
| Amino modified silicone (KS-343, mfd. by Shinetsu Kagaku Kogyo K.K.) | 6 parts |
| Epoxy modified silicone (KF-393, mfd. by Shinetsu Kagaku Kogyo K.K.) | 6 parts |
| Methyl ethyl ketone/toluene (wt ratio = 1/1) | 400 parts |
| **Composition of coating liquid for intermediate layer** | |
| Polyester resin (Biron #200, mfd. by Toyobo K.K.) | 100 parts |
| Polyisocyanate resin (Sumijule, mfd. by Sumitomo Baielurethane K.K.) | 10 parts |
| Methyl ethyl ketone/toluene (wt. ratio = 1/1) | 400 parts |
| **Composition of coating liquid for adhesive layer** | |
| Polymethyl methacrylate resin (BR-106, mfd. by Mitsubishi Rayon K.K.) | 100 parts |
| Titanium oxide (TCA-888, mfd. by Tohchem Products K.K., average particle size = 0.2 μm) | 50 parts |
| Methyl ethyl ketone/toluene (wt. ratio = 1/1) | 300 parts |

EXAMPLE F2

A receptor layer transfer sheet according to the present invention was prepared in the same manner as in Example F1 except that the following coating liquid was used so as to provide a thickness of 2 g/m$^2$ instead of the coating liquid for intermediate layer used in Example F1.

| Composition of coating liquid for intermediate layer | |
|---|---|
| Polyester resin (BX-1, mfd. by Sekisui Kagaku K.K.) | 100 parts |
| Polyisocyanate resin (Barnock D 750, mfd. by Dai Nippon Ink kagaku K.K.) | 10 parts |
| Methyl ethyl ketone/toluene (wt. ratio = 1/1) | 300 parts |

EXAMPLE F3

A receptor layer transfer sheet according to the present invention was prepared in the same manner as in Example F1 except that the following coating liquid was used so as to provide a thickness of 2 g/m$^2$ instead of the coating liquid for intermediate layer used in Example F1.

| Composition of coating liquid for intermediate layer | |
|---|---|
| Acrylpolyol resin (Thermorack U230, mfd. by Soken kagaku K.K.) | 100 parts |
| Polyisocyanate resin (Takenate D-102, mfd. by Takeda Yakuhin kogyo K.K.) | 10 parts |
| Methyl ethyl ketone/toluene (wt. ratio = 1/1) | 300 parts |

EXAMPLE F4

A receptor layer transfer sheet according to the present invention was prepared in the same manner as in Example F1 except that the following coating liquid was used so as to provide a thickness of 2 g/m$^2$ instead of the coating liquid for intermediate layer used in Example F1.

| Composition of coating liquid for intermediate layer | |
|---|---|
| Melamine resin (Nikarack MW-22, mfd. by Sanwa Chemical K.K.) | 100 parts |
| Polyisocyanate resin (Desmodule HL, mfd. by Sumitomo Baielurethane K.K.) | 10 parts |
| Methyl ethyl ketone/toluene (wt. ratio = 1/1) | 400 parts |

COMPARATIVE EXAMPLE F1

A receptor layer transfer sheet of Comparative Example was prepared in the same manner as in Example F1 except that the following coating liquid was used so as to provide a thickness of 2 g/m$^2$ instead of the coating liquid for intermediate layer used in Example F1.

| Composition of coating liquid for intermediate layer | |
|---|---|
| Polyester resin (Erieter UE3201, mfd. by Unichika K.K.) | 100 parts |
| Polyamine (Totoamine HL 102, mfd. by Toto Kasei K.K.) | 5 parts |
| Methyl ethyl ketone/toluene (wt. ratio = 1/1) | 300 parts |

COMPARATIVE EXAMPLE F2

A receptor layer transfer sheet of Comparative Example was prepared in the same manner as in Example F1 except that the intermediate layer was not formed.

The receptor layer transfer sheet as described above was superposed on plain paper and a receptor layer was transferred to the plain paper by means of a hot roller. Then, the same thermal transfer sheet as that used in Example A was superposed on the plain paper so that the thermal transfer sheet contacted the surface of the above receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 6.

TABLE 6

| | Film cutting | Image quality |
|---|---|---|
| Example F1 | Good | Good |
| Example F2 | Good | Good |
| Example F3 | Good | Good |
| Example F4 | Good | Good |
| Comparative Example F1 | Surface unevenness was produced. | White dropout was produced in the image. |
| Comparative Example F2 | Fibers were partially exposed to the surface. | White dropout was produced in the image. |

EXAMPLE G1

A coating liquid for a receptor layer having the following composition was applied onto a surface of a 25 μm thick polyester film (tradename: Lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Then, a coating liquid for an intermediate layer having the following composition was applied onto the surface of the above receptor layer so as to provide a coating amount of 2 g/m$^2$ (after drying) and then dried in the same manner as described above, whereby an intermediate layer was formed. Thereafter, a solution of an adhesive agent having the following composition was applied onto the above intermediate layer so as to provide a coating amount of 2 g/m$^2$ (after drying) and then dried in the same manner as described above, whereby an adhesive layer was formed. Then, the resultant product was subjected to crosslinking treatment at 120° C. for 10 min., whereby a receptor layer transfer sheet according to the present invention was obtained.

| Composition of coating liquid for receptor layer | |
|---|---|
| Vinyl chloride/vinyl acetate copolymer (VYHD, mfd. by Union Carbide Co.) | 100 parts |
| Amino modified silicone (KS-343, mfd. by Shinetsu Kagaku Kogyo K.K.) | 6 parts |
| Epoxy modified silicone (KF-393, mfd. by Shinetsu Kagaku Kogyo K.K.) | 6 parts |
| Methyl ethyl ketone/toluene (wt. ratio = 1/1) | 400 parts |
| **Composition of coating liquid for intermediate layer** | |
| Acryl emulsion (AE 120, mfd. by Nippon Gosei Gomu K.K.) | 100 parts |
| **Composition of coating liquid for adhesive agent layer** | |
| Polymethyl methacrylate resin (BR-106, mfd. by Mitsubishi Rayon K.K.) | 100 parts |
| Titanium oxide (TCA-888, mfd. by Tohchem Products K.K., average particle size = 0.2 μm) | 50 parts |
| Methyl ethyl ketone/toluene (wt. ratio = 1/1) | 300 parts |

EXAMPLE G2

A receptor layer transfer sheet according to the present invention was prepared in the same manner as in Example G1 except that the following coating liquid was used so as to provide a thickness of 3 g/m$^2$ instead of the coating liquid for intermediate layer used in Example G1.

| Composition of coating liquid for intermediate layer | |
|---|---|
| Polyester resin (Chemite KS7017W5, Tg = −11° C., mfd. by Toray K.K.) | 100 parts |
| Methyl ethyl ketone/toluene (wt. ratio = 1/1) | 400 parts |

EXAMPLE G3

A receptor layer transfer sheet according to the present invention was prepared in the same manner as in Example G1 except that the following coating liquid was used so as to provide a thickness of 2 g/m$^2$ instead of the coating liquid for intermediate layer used in Example G1.

| Composition of coating liquid for intermediate layer | |
|---|---|
| Polyurethane resin (E-701, Tg = +2° C., mfd. by Takeda Yakuhin Kogyo K.K.) | 100 parts |
| Methyl ethyl ketone/toluene (wt. ratio = 1/1) | 500 parts |

EXAMPLE G4

A receptor layer transfer sheet according to the present invention was prepared in the same manner as in Example G1 except that the following coating liquid was used so as to provide a thickness of 2 g/m$^2$ instead of the coating liquid for intermediate layer used in Example G1.

| Composition of coating liquid for intermediate layer | |
|---|---|
| Polyurethane resin (E-760, Tg = 33° C., mfd. by Takeda Yakuhin Kogyo K.K.) | 100 parts |
| Methyl ethyl ketone/toluene (wt. ratio = 1/1) | 400 parts |

COMPARATIVE EXAMPLE G1

A receptor layer transfer sheet of Comparative Example was prepared in the same manner as in Example G1 except that the following coating liquid was used so as to provide a thickness of 2 g/m$^2$ instead of the coating liquid for intermediate layer used in Example G1.

| Composition of coating liquid for intermediate layer | |
|---|---|
| Acryl emulsion (AE-336, mfd. by Nippon Gosei Gomu K.K.) | 100 parts |

COMPARATIVE EXAMPLE G2

A receptor layer transfer sheet of Comparative Example was prepared in the same manner as in Example G1 except that the following coating liquid was used so as to provide a thickness of 2 g/m$^2$ instead of the coating liquid for intermediate layer used in Example G1.

| Composition of coating liquid for intermediate layer | |
|---|---|
| Acryl emulsion (HD-11, mfd. by Toa Gosei Kagaku K.K.) | 100 parts |

COMPARATIVE EXAMPLE G3

A receptor layer transfer of Comparative Example was prepared in the same manner as in Example G1 except that the intermediate layer was not formed.

The receptor layer transfer sheet as described above was superposed on plain paper and a receptor layer was transferred to the plain paper by means of a hot roller. Then, the same thermal transfer sheet as that used in Example A was superposed on the plain paper so that the thermal transfer sheet contacted the surface of the above receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 7.

TABLE 7

| | Film cutting | Image quality |
|---|---|---|
| Example G1 | Good | Good |
| Example G2 | Good | Good |
| Example G3 | Good | Good |
| Example G4 | Good | Good |
| Comparative Example G1 | Film cutting property was bad and tailing occured. | Good |
| Comparative Example G2 | Good | White dropout was produced in the image. |
| Comparative Example G3 | Good | White dropout was produced in the image. |

EXAMPLE H1

A coating liquid for a receptor layer having the following composition was applied onto a surface of a 25 μm thick polyester film (tradename: Lumirror, mfd. by Toray K.K.) by means of a bar coater so as to provide a coating amount of 5.0 g/m$^2$ (after drying), and the resultant coating was preliminarily dried by means of a dryer, and then dried in an oven for 30 min. at 100° C., whereby a dye receptor layer was formed.

Then, a coating liquid for barrier layer having the following composition was applied onto the surface of the above receptor layer so as to provide a coating amount of 3 g/m$^2$ (after drying) and then dried in the same manner as described above, whereby an intermediate layer was formed.

Thereafter, a coating liquid for an adhesive layer (which also functions as a bubble containing layer) having the following composition was applied onto the above intermediate layer so as to provide a coating amount of 2 g/m$^2$ (after drying) and then dried in the same manner as described above, whereby an adhesive layer also functions as a bubble containing layer was formed. Then, the resultant product was subjected to foaming treatment at 130° C. for 2 min., whereby a receptor layer transfer sheet according to the present invention was obtained.

| Composition of coating liquid for receptor layer | |
|---|---|
| Vinyl chloride/vinyl acetate copolymer (VYHD, mfd. by Union Carbide Co.) | 100 parts |
| Amino modified silicone (KS-343, mfd. by Shinetsu Kagaku Kogyo K.K.) | 1 part |
| Epoxy modified silicone (KF-393, mfd. by Shinetsu Kagaku Kogyo K.K.) | 1 part |
| Methylethylketone/toluene (wt. ratio = 1/1) | 500 parts |
| **Composition of coating liquid for intermediate layer** | |
| Polymethyl methacrylate resin (BR-106, mfd. by Mitsubishi Rayon K.K.) | 100 parts |
| Methylethylketone/toluene (wt. ratio = 1/1) | 500 parts |
| **Composition of coating liquid for adhesive layer** | |
| Polymethyl methacrylate resin (BR-106, mfd. by Mitsubishi Rayon K.K.) | 100 parts |
| Azodicarboamide foaming agent (Vyniball AK #2, mfd. by Nagai Kasei K.K.) | 10 parts |
| Titanium oxide (TCA-888, mfd. by Tohchem Products K.K. average particle size = 0.2 μm) | 100 parts |
| Methylethylketone/toluene (wt. ratio = 1/1) | 500 parts |

EXAMPLE H2

A receptor layer transfer sheet according to the present invention was prepared in the same manner as in Example H1 except that 15 parts of microcapsules (F-30D, mfd. by Matsumoto Yushi Seiyaku) were used instead of the foaming agent used in Example H1.

EXAMPLE H3

A receptor layer transfer sheet according to the present invention was prepared in the same manner as in Example H1 except that 15 parts of microcapsules (F-30D/TiO2, mfd. by Matsumoto Yushi Seiyaku) coated with titanium compound were used instead of the foaming agent used in Example H1.

EXAMPLE H4

The coating liquid for a receptor layer used in Example H1 was applied onto the polyester film used in Example H1 so as to form a dye receptor layer is the same manner as in Example H1.

Then, a coating liquid for intermediate layer having the following composition was applied onto the surface of the above receptor layer so as to provide a coating amount of 3 g/m$^2$ (after drying) and then dried in the same manner as in Example H1, whereby an intermediate layer was formed.

Further, a coating liquid for foaming agent layer having the following composition was applied onto the surface of the intermediate layer so as to provide a coating amount of 3 g/m$^2$ (after drying) and then dried in the same manner as described above, whereby a foaming agent layer was formed.

Thereafter, a coating liquid for an adhesive layer having the following composition was applied onto the above foaming agent layer so as to provide a coating amount of 2 g/m$^2$ (after drying) and then dried in the same manner as described above, whereby an adhesive layer was formed. Then, the resultant product was subjected to foaming treatment at 130° C. for 2 min., whereby a receptor layer transfer sheet according to the present invention was obtained.

| Composition of coating liquid for intermediate layer | |
|---|---|
| Acrylpolyol resin (Thermorack U230, mfd. by Soken Kagaku K.K.) | 100 parts |
| Titanium oxide (TCA-888, mfd. by Tohchem Product K.K.) | 50 parts |
| Polyisocyanate resin (Takenate D-102, mfd. by Takeda Yakuhin Kogyo K.K.) | 10 parts |
| Methylethyl ketone/toluene (wt. ratio = 1/1) | 300 parts |
| **Composition of coating liquid for foaming agent layer** | |
| Acryl emulsion (AE-120, Tg = −10° C., mfd. by Nippon Gosei Gomu K.K.) | 100 parts |
| Heat-foaming type microcapsule (F-30D, mfd. by Matsumoto Yushi Seiyaku K.K.) | 10 parts |
| **Composition of coating liquid for adhesive layer** | |
| Polymethylmethacrylate resin (BR-106, mfd. by Mitsubishi Rayon K.K.) | 100 parts |
| Titanium oxide (TCA-888, mfd. by Tohchem Products K.K., average particle size = 0.2 μm) | 50 parts |
| Methylethylketone/toluene (wt. ratio = 1/1) | 300 parts |

EXAMPLE H5

A receptor layer transfer sheet according to the present invention was prepared in the same manner as in Example H1 except that the coating liquid for the intermediate layer used in Example H4 and the following coating liquid for the adhesion layer instead of these used in Example H1.

| Composition of coating liquid for adhesive layer | |
|---|---|
| Polymethylmethacrylate resin (BR-106, mfd. by Mitsubishi Rayon K.K.) | 100 parts |
| Heat-forming type microcapsule (F-30D, mfd. by Matsumoto Yushi Seiyaku K.K.) | 10 parts |
| Titanium oxide (TCA-888, mfd. by Tohchem Products K.K., average particle size = 0.2 μm) | 50 parts |
| Methylethylketone/toluene (wt. ratio = 1/1) | 300 parts |

COMPARATIVE EXAMPLE H1

A receptor layer transfer sheet of Comparative Example was prepared in the same manner as in Example H1 except that the foaming agent used in Example H1 was not used.

The receptor layer transfer sheet as described above was superposed on plain paper and a receptor layer was transferred to the plain paper by means of a hot roller. Then, the same thermal transfer sheet as that used in Example A was superposed on the plain paper so that the thermal transfer sheet contacted the surface of the above receptor layer, and printing operation was effected by means of a thermal head under the following conditions, thereby to form a cyan image.

Output: 1 W/dot,

Pulse width (or pulse duration): 0.3 to 0.45 msec.,

Dot density: 3 dots/mm

The resultant image quality of the thus obtained images was shown in the following Table 8.

TABLE 8

| | Image clearness | White dropout in image |
|---|---|---|
| Example H1 | The receptor layer was white and the image was clear. | No white dropout was produced in the resultant image. |
| Example H2 | The recepter layer was white and the image was clear. | No white dropout was produced in the resultant image. |
| Example H3 | The receptor layer was white and the image was clear. | No white dropout was produced in the resultant image. |
| Example H4 | The recepter layer was white and the image was clear. | No white dropout was produced in the resultant image. |
| Example H5 | The receptor layer was white and the image was clear. | No white dropout was produced in the resultant image. |
| Comparative Example H1 | The receptor layer was white and the image was clear. | White dropout was produced in the image. |

EXAMPLE I1

A solution of a heat curing acrylic urethane type resin (mfd. by Showa Ink K.K.) was applied onto a 25 μm thick polyethylene terephthalate film (#25, mfd. by Toray K.K.) of which back surface had been provided with a heat resistant lubricating layer, by gravure coating so as to provide a thickness (after drying) of 1 μm or below (0.3 to 0.5 μm), and the resultant coating was dried at 170° C. for 1 min., thereby to form an adhesion promotion layer.

Onto the surface of the thus formed adhesion promotion layer, a coating liquid for a release layer having the following composition was applied so as to provide 30 cm wide coating layers at intervals of a width of 90 cm and to provide a coating amount of 0.5 g/m$^2$ (after drying), and then the resultant coating was dried to form a release layer.

| Coating liquid for release layer | |
|---|---|
| Polyvinyl alcohol resin (KL-05, mfd. by Nihon Gosei Kagaku K.K.) | 5 parts |
| Water | 100 parts |

Then, a coating liquid for a receptor layer having the following composition was applied so that the resultant coating corresponds to the above release layer by means of a bar coater so as to provide a coating amount of 3.0 g/m$^2$ (after drying), and the resultant coating was preliminarily dried by means of a dryer, and then dried in an oven for 30 min. at 100° C., whereby a dye receptor layer was formed.

Thereafter, a solution of an adhesive agent having the following composition was applied so that the resultant coating corresponds to each of the above receptor layers so as to provide a coating amount of 3.0 g/m$^2$ (after drying) and then dried in the same manner as described above, whereby an adhesive layer was formed.

| Composition of coating liquid for receptor layer | |
|---|---|
| Vinyl chloride/vinyl acetate copolymer (VYHD, mfd. by Union Carbide Co.) | 100 parts |
| Amino modified silicone (X-22-343, mfd. by Shinetsu Kagaku Kogyo K.K.) | 3 parts |
| Epoxy modified silicone (KF-393, mfd. by Shinetsu Kagaku Kogyo K.K.) | 3 parts |
| Methyl ethyl ketone/toluene (wt. ratio = 1/1) | 500 parts |

-continued

| Composition of coating liquid for adhesive layer | |
|---|---|
| Ethylene vinylacetate copolymer type heat sealing agent (AD 37P295, mfd. by Toyo Morton K.K.) | 100 parts |
| Water | 100 parts |

Then, an ink for a blue dye layer having the following composition was prepared and the resultant coating liquid was applied onto the surface of the substrate on which the release layer had not been formed, by means of a gravure coater so as to provide a 30 cm wide coating layers and to provide a coating amount of 1.0 g/m$^2$ (after drying), and then dried, whereby the blue dye layer was formed.

| Ink composition of dye layer | |
|---|---|
| Disperse dye (Kayaset Blue 714, mfd. by Nihon Kayaku K.K.) | 4.0 parts |
| Ethyl hydroxycellulose (mfd. by Hercules Co.) | 5.0 parts |
| Methyl ethyl ketone/toluene (wt. ratio = 1/1) | 80.0 parts |
| Dioxane | 10.0 parts |

A yellow dye layer was formed on the surface of the substrate, on which the receptor layer and the blue dye layer had not been formed, in the same manner as described above except for using a yellow disperse dye (Macrolex Yellow 6G, mfd. by Bayer, C.I. Disperse Yellow 201) instead of the above disperse dye.

Then, a magenta dye layer was formed on the surface of the substrate, on which the receptor layer, the blue dye layer and the yellow dye layer had not been formed, in the same manner as described above except for using a magenta disperse dye (C.I. Disperse Red 60) instead of the above disperse dye, whereby a thermal transfer sheet according to the present invention was obtained.

The thermal transfer sheet as described above was superposed on plain paper so that the receptor layer of the thermal transfer sheet contacted the plain paper, and the receptor layer was transferred to the plain paper by means of a thermal head under the following conditions, thereby to cover the entire surface of the plain paper with the resultant receptor layer.

Output: 1 W/dot,

Pulse width (or pulse duration): 0.3 to 0.45 msec.,

Dot density: 3 dots/mm

Then, onto the surface of the thus transferred receptor layer, printing was effected in accordance with a yellow signal (i.e., signal to be used for forming a yellow color image) which had been obtained by subjecting an original to color separation, so that the yellow dye layer was superposed on the surface of the receptor layer to form an yellow image.

Onto the thus formed image region, the above magenta dye was transferred in accordance with a magenta signal, and further the above cyan dye was transferred in accordance with a cyan signal in the same manner as described above, whereby a full color image was formed.

EXAMPLES I2 TO I14 and COMPARATIVE EXAMPLES I1 to I3

Sixteen species of thermal transfer sheets were prepared in the same manner as in Example I1 except that each of the coating liquids for release layer as shown in the following Table 9 was used for forming the release layer instead of that used in Example I1.

Then, full color images were formed in the same manner as in Example I1 except for using each of the thus prepared thermal transfer sheet, instead of that used in Example I1.

TABLE 9

| | Resin for release layer | |
|---|---|---|
| Example I2 | Polyvinylacetal resin (S LEC KS-1, mfd. by Sekisui Kagaku Kogyo K.K.) | 5 parts |
| | MEK/toluene | 100 parts |
| Example I3 | Polyvinyl butyral resin (S LEC BL-1, mfd. by Sekisui Kagaku Kogyo K.K.) | 5 parts |
| | MEK/toluene | 100 parts |
| Example I4 | Polyvinyl pyrrolidone resin (mfd. by BASF) | 5 parts |
| | Water | 100 parts |
| Example I5 | Polyamide resin (copolymer nylon, mfd. by Ube Kosan K.K.) | 5 parts |
| | Ethanol | 100 parts |
| Example I6 | Polyurethane resin varnish (Hydran AP-20, mfd. by Dainihon Ink K.K.) | |
| Example I7 | Cellulose resin (ethyl hydroxy cellulose, mfd. by Hercules Co.) | 5 parts |
| | MEK/toluene | 100 parts |
| Example I8 | Cellulose resin (hydroxypropyl cellulose, mfd. by Nihon Soda K.K.) | 5 parts |
| | Ethanol | 100 parts |
| Example I9 | Polycarbonate resin (Eupiron H 3000, mfd. by Mitsubishi Gas Kagaku K.K.) | 5 parts |
| | Methylene chloride | 100 parts |
| Example I10 | Acrylonitrile styrene copolymer (mfd. by Daiseru K.K.) | 5 parts |
| | MEK/toluene | 100 parts |
| Example I11 | Tris(methacryloxyethyl)isocyanurate (FA-731M, mfd. by Hitachi Kasei Kogyo K.K.) | 20 parts |
| | MEK/toluene (The coating after drying was crosslinked by electron beam radiation) | 100 parts |
| Example I12 | Pentaerythritol tetraacrylate (SR-295, mfd. by Thertomer Co.) | 20 parts |
| | 2-ethylhexylmethacrylate (Light Ester EH, mfd. by Kyoei Yushi Kagaku Kogyo K.K. | 10 parts |
| | 1-hydroxycyclohexyl phenyl ketone (Irgacure 184, mfd. by Nihon Ciba Geigy) | 1 part |
| | MEK/toluene (The coating after drying was crosslinked by electron beam radiation) | 100 parts |
| Example I13 | Polyvinyl alcohol (KL-5, mfd. by Nihon Gosei Kagaku K.K.) | 5 parts |
| | Titanium lactate (Orgatics TC310, mfd. by Matsumoto Seiyaku Kogyo K.K.) | 0.1 part |
| | Water | 100 parts |
| Example I14 | Polyvinyl alcohol (KL-5, mfd. by Nihon Gosei Kagaku K.K.) | 5 parts |
| | Kaolin (mfd. by Shiraishi Kogyo K.K.) | 0.5 part |
| | Water | 100 parts |
| Comparative Example I1 | No release layer was provided but the receptor layer was directly formed on the adhesion promotion layer by coating. | |
| Comparative Example I2 | Polyester resin (Eliter UE-3200, mfd. by Unitika K.K.) | 5 parts |
| | MEK/toluene | 100 parts |

TABLE 9-continued

| | Resin for release layer | |
|---|---|---|
| Comparative Example I3 | Acrylic resin (mfd. by Mitsubishi Rayon K.K.) | 5 parts |
| | MEK/toluene | 100 parts |

When iamge formation was effected on each of the above thermal transfer sheets of Examples and Comparative Examples, the resultant peelability of the receptor layer, the film cutting property at the time of the transfer of the receptor layer and the releasability at the time of the image formation were evaluated.

The results were shown in the following Table 10.

TABLE 10

| | Peelability | Film cutting property | Releasability |
|---|---|---|---|
| Example I1 | Good | Good | Good |
| Example I2 | Good | Good | Good |
| Example I3 | Good | Good | Good |
| Example I4 | Good | Good | Good |
| Example I5 | Good | Good | Good |
| Example I6 | Good | Good | Good |
| Example I7 | Good | Good | Good |
| Example I8 | Good | Good | Good |
| Example I9 | Good | Good | Good |
| Example I10 | Good | Good | Good |
| Example I11 | Good | Good | Good |
| Example I12 | Good | Good | Good |
| Example I13 | Good | Excellent | Good |
| Example I14 | Good | Excellent | Good |
| Comparative Example I1 | Peeling did not occur. | — | — |
| Comparative Example I2 | Thermal sticking | — | — |
| Comparative Example I3 | Good | Good | Abnormal transfer |

EXAMPLES J1 TO J10, COMPARATIVE EXAMPLE J1

Coating liquids having the following compositions were applied onto a releasability imparted surface of a 4.5 μm thick polyethylene terephthalate film (mfd. by Toray K.K.) wehrein the back surface thereof had been provided with a heat resistant lubricating layer, and the other surface thereof had been subjected to releasability imparting treatment, in accordance with the following Table 11, so that 30 cm wide superpositions of a receptor layer, an intermediate layer and an adhesive layer were formed at intervals of 90 cm.

More specifically, the receptor layer was formed by applying the coating liquid having the following composition by a bar coater so as to provide a coating amount of 3.0 g/m$^2$ (after drying), preliminarily drying the resultant coating and drying the coating in an oven at 100° C. for 30 min. The intermediate layer was formed by applying an urethane emulsion (Hydran AP-70, mfd. by Dainihon Ink Kagaku Kogyo K.K.) so as to provide a coating amount of 3.0 g/m$^2$ (solid content) and drying the resultant coating. Further, the adhesive layer was formed by applying the following adhesive agent solution so as to provide a coating amount of 3.0 g/m$^2$ (after drying) and drying the resultant coating in the same manner as described above.

| Composition of coating liquid for receptor layer | |
|---|---|
| Vinyl chloride/vinyl acetate copolymer (VYHD, mfd. by Union Carbide Co.) | 100 parts |
| Amino modified silicone (X 22 343, mfd. by Shinetsu Kagaku Kogyo K.K.) | 3 parts |
| Epoxy modified silicone (KF 393, mfd. by Shinetsu Kagaku Kogyo K.K.) | 3 parts |
| Methyl ethyl ketone/toluene (wt. ratio = 1/1) | 500 parts |
| **Composition of coting liquid for adhsive layer** | |
| Ethylene/vinyl acetate copolymer type heat sealing agent (AD 37P295, mfd. by Toyo Morton K.K.) | 100 parts |
| Water | 100 parts |

Then, an ink for a dye blue layer having the following composition was prepared and the resultant coating liquid was applied onto the surface of the substrate on which the receptor layer had not been formed, by means of a gravure coater so as to provide a 30 cm wide coating layers and to provide a coating amount of 1.0 g/m$^2$ (after drying), and then dried, whereby the blue dye layer was formed.

| Ink composition of dye layer | |
|---|---|
| Disperse dye (Kayaset Blue 714, mfd. by Nihon Kayaku K.K.) | 4.0 parts |
| Ethyl hydroxycellulose (mfd. by Hercules Co.) | 5.0 parts |
| Methyl ethyl ketone/toluene (wt. ratio = 1/1) | 80.0 parts |
| Dioxan | 10.0 parts |

A yellow dye layer was formed on the surface of the substrate, on which the receptor layer and the blue dye layer had not been formed, in the same manner as described above except for using a yellow disperse dye (Macrolex Yellow 6G, mfd. by Bayer, C.I. Disperse Yellow 201) instead of the above disperse dye.

Then, a magenta dye layer was formed on the surface of the substrate, on which the receptor layer, the blue dye layer and the yellow dye layer had not been formed, in the same manner as described above except for using a magenta disperse dye (C.I. Disperse Red 60) instead of the above disperse dye, whereby thermal transfer sheet according to the present invention and Comparative Example were obtained.

TABLE 11

| | Receptor layer | Intermediate layer | Adhesive layer |
|---|---|---|---|
| Example J1 | White pigment 50 parts | (Not formed) | No additive |
| Example J2 | Fluorescent brightener 1 part | (Not formed) | No additive |
| Example J3 | Foaming agent 10 parts | (Not formed) | No additive |
| Example J4 | No additive | (Not formed) | White pigment 20 parts |
| Example J5 | No additive | (Not formed) | Fluorescent brightener 0.5 part |
| Example J6 | No additive | (Not formed) | Foaming agent 5 parts |
| Example J7 | No additive | White pigment 5 parts | No additive |

TABLE 11-continued

| | Receptor layer | Intermediate layer | Adhesive layer |
|---|---|---|---|
| Example J8 | No additive | Fluorescent brightener 0.3 part | No additive |
| Example J9 | No additive | Foaming agent 3 parts | No additive |
| Example J10 | Fluorscent brightener 0.3 part | White pigment 5 parts | Foaming agent 1 part |
| Comparative Example J1 | No additive | No additive | No additive |

White pigment: titanium dioxide (TCA-888, mfd. by Tohchem Products K.K.)

Fluorescent brightener: Yubitex OB (mfd. by Ciba Geigy)

Foaming agent: thermally expandable microcapsules (F50, mfd. by Matsumoto Yushi Seiyaku K.K.)

The thermal transfer sheet as described above was superposed on plain paper so that the receptor layer of the thermal transfer sheet contacted the plain paper and the receptor layer was transferred to the plain paper by means of a thermal head under the following conditions, thereby to cover the entire surface of the plain paper with the resultant receptor layer.

Output: 1 W/dot,

Pulse width (or pulse duration): 0.3 to 0.45 msec.,

Dot density: 3 dots/mm

Then, onto the surface of the thus transferred receptor layer, printing was effected in accordance with a yellow signal (i.e., signal to be used for forming a yellow color image) which had been obtained by subjecting an original to color separation, so that the yellow dye layer was superposed on the surface of the receptor layer to form an yellow image.

Onto the thus formed image region, the above magenta dye was transferred in accordance with a magenta signal, and further the above cyan dye was transferred in accordance with a cyan signal in the same manner as described above, whereby a full color image was formed.

With respect to the thus formed images, the clearness, color reproducibility and image quality was evaluated.

The results are shown in the following Table 12.

TABLE 12

| | Clearness | Color reproducibility | Image quality |
|---|---|---|---|
| Example J1 | Excellent | Good | Poor |
| Example J2 | Good | Excellent | Poor |
| Example J3 | Good | Poor | Excellent |
| Example J4 | Excellent | Good | Poor |
| Example J5 | Good | Excellent | Poor |
| Example J6 | Good | Poor | Excellent |
| Example J7 | Excellent | Good | Poor |
| Example J8 | Good | Excellent | Poor |
| Example J9 | Good | Poor | Excellent |
| Example J10 | Excellent | Excellent | Excellent |
| Comparative Example J1 | Poor | Poor | Poor |

EXAMPLE K1

Coating liquid having the following composition was applied onto a releasability imparted surface of a 4.5 μm thick polyethylene terephthalate film (mfd. by Toray K.K.)

wherein the back surface thereof had been provided with a heat resistant lubricating layer, and the other surface thereof had been subjected to releasability imparting treatment, and the resultant coating was dired so that 30 cm wide receptor layers having a thickness (after drying) of 2 μm were formed at intervals of 90 cm. Thereafter, a solution of an adhesive agent having the following composition was applied on the receptor layer, and the resultant coating was dried so as to provide a adhesive layer having a thickness (after drying) of 2 μm.

| Composition of coating liquid for receptor layer | |
|---|---|
| Vinyl chloride/vinyl acetate copolymer (VYHD, mfd. Union Carbide Co.). | 100 parts |
| Amino modified silicone (X-22-343, mfd. by Shinetsu Kagaku Kogyo K.K.) | 8 parts |
| Epoxy modified silicone (KF-393, mfd. by Shinetsu Kagaku Kogyo K.K.) | 8 parts |
| Methyl ethyl ketone/toluene (wt. ratio = 1/1) | 400 parts |
| **Composition of coating liquid for adhesive layer** | |
| Acrylic resin (BR-106, mfd. by Mitsubishi Rayon K.K.) | 100 parts |
| Methyl ethyl ketone/toluene (wt. ratio = 1/1) | 300 parts |

Then, an ink for an adhesive layer and an ink for yellow dye layers of three colors having the following compositions were respectively prepared, and were sequentially applied onto the surface of the substrate film on which the receptor layer had not been formed, in a sequence of from the adhesive layer ink to the yellow dye layer ink, by means of a gravure coater so as to provide a 30 cm wide coating layers and to provide a coating amounts of 0.5 μm and 1.0 μm (after drying) respectively, and then dried, whereby a thermal transfer sheet according to the present invention was obtained.

| Ink composition for adhesive layer | |
|---|---|
| Polyester resin (Adcoat 335A) | 35 parts |
| Methyl ethyl ketone/toluene (wt. ratio = 1/1) | 65 parts |
| **Ink composition of yellow dye layer** | |
| Disperse dye (Macrolex yellow 6G, mfd. by Bayer) | 5.5 parts |
| Polyvinyl butyral resin (S LEC BX-1, Sekisui Kagaku K.K.) | 4.5 parts |
| Methyl ethyl ketone/toluene (wt. ratio = 1/1) | 89.0 parts |

Inks for a magenta dye layer and a cyan dye layer were prepared in the same manner as described above except that disperse dyes (C.I. Disperse Red 6G, and C.I. Solvent Blue 63) were respectively used instead of the above yellow disperse dye.

EXAMPLES K2 TO K4 AND COMPARATIVE EXAMPLES K1 to K2

Five species of thermal transfer sheets according to the present invention and Comparative Examples were prepared in the same manner as in Example K1 except that the thickness of the dye receptor layer and the adhesive layer were changed in the following manner.

| | Receptor layer | Adhesive layer |
|---|---|---|
| Example K2 | 2 μm | 20 μm |
| Example K3 | 20 μm | 2 μm |
| Example K4 | 10 μm | 15 μm |
| Comparative Example K1 | 1 μm | 1 μm |
| Comparative Example K2 | 20 μm | 20 μm |

EXAMPLE K5

In addition to the ink compositions prepared in Example K1, an ink for transferable protection layer having the following composition was prepared.

By use of these inks, (3 μm-thick dye receptor layer+5 μm-thick dye receptor layer), dye layers of three colors, and (3 μm-thick transferable protection layer+5 μm-thick adhesive layer) were sequentially formed on the substrate surface as shown in FIG. 11, whereby a thermal transfer sheet according to the present invention was prepared.

| Ink composition for protection layer | |
|---|---|
| Polyester resin (Bairon 600, mfd. by Toyobo K.K.) | 20.0 parts |
| Epoxy modified silicone (KF 393, mfd. by Shinetsu Kagaku K.K.) | 0.5 part |
| Methyl ethyl ketone/toluene (wt. ratio = 1/1) | 80.0 parts |

Each of the thermal transfer sheet according to the present invention and Comparative Examples as described above was wound up into a roll having a diameter of 15 cm, and the resultant winding creases (or wrinkles) were evaluated.

Then, each of the above thermal transfer sheets was wound off and was superposed on plain paper so that the receptor layer of the thermal transfer sheet contacted the plain paper and the receptor layer was transferred to the plain paper by means of a thermal head under the following conditions, thereby to cover the entire surface of the plain paper with the resultant receptor layer.

Output: 1 W/dot,

Pulse width (or pulse duration): 0.3 to 0.45 msec.,

Dot density: 3 dots/mm

Then, onto the surface of the thus transferred receptor layer, printing was effected in accordance with a yellow signal (i.e., signal to be used for forming a yellow color image) which had been obtained by subjecting an original to color separation, so that the yellow dye layer was superposed on the surface of the receptor layer to form an yellow image.

Onto the thus formed image region, the above magenta dye was transferred in accordance with a magenta signal, and further the above cyan dye was transferred in accordance with a cyan signal in the same manner as described above, whereby a full color image was formed.

The resultant transferability of the dye, peelability of the receptor layer and the image quality of the thus formed images were evaluated.

The results are shown in the following Table 13.

TABLE 13

| | Image quality | Occurrence of winding creases |
|---|---|---|
| Example K1 | Good | None |
| Example K2 | Excellent | None |
| Example K3 | Excellent | None |
| Example K4 | Excellent | None |
| Example K5 | Excellent | None |
| Comparative Example K1 | Not good | None |
| Comparative Example K2 | Good | Observed |

What is claimed is:

1. A receptor layer transfer sheet comprising a substrate sheet and a transferable layer disposed on one side surface of the substrate sheet, the transferable layer being peelable from the substrate sheet and comprising a dye receptor layer, wherein the transferable layer has an adhesive layer disposed thereon by the medium of an intermediate layer, and at least one layer selected from the dye receptor layer, intermediate layer and the adhesive layer contains bubbles.

2. A receptor layer transfer sheet comprising a substrate sheet and a transferable layer disposed on one side surface of the substrate sheet, the transferable layer being peelable from the substrate sheet and comprising a dye receptor layer, wherein the transferable layer has an adhesive layer disposed thereon, and at least one layer selected from the dye receptor layer and the adhesive layer contains bubbles.

3. A receptor layer transfer sheet comprising a substrate sheet and a transferable layer disposed on one side surface of the substrate sheet, the transferable layer being peelable from the substrate sheet and comprising a dye receptor layer end an adhesive layer disposed thereon, wherein at least one layer selected form the dye receptor layer end the adhesive layer contains a white pigment and bubbles.

4. A receptor layer transfer sheet according to claim 3, wherein the transferable layer comprises the dye receptor layer and an adhesive layer disposed thereon by the medium of an intermediate layer, and at least one layer selected from the dye receptor layer, the intermediate layer and the adhesive layer contains the white pigment and the bubbles.

5. A receptor layer transfer sheet comprising a substrate sheet and a transferable layer disposed on one side surface of the substrate sheet, the transferable layer being peelable from the substrate sheet, the transferable layer being peelable from the substrate sheet and comprising a dye receptor layer, and an adhesive layer disposed thereon wherein at least one layer selected from the dye receptor layer and the adhesive layer contains bubbles covered with a white pigment.

6. A receptor layer transfer sheet according to claim 5, wherein the transferable layer comprises the dye receptor layer and an adhesive layer disposed thereon by the medium of an intermediate layer, and at least one layer selected form the dye receptor layer, the intermediate layer and the adhesive layer contains the bubbles covered with the white pigment.

7. A receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, and a bubble containing adhesive layer disposed on the intermediate layer.

8. A receptor layer transfer sheet comprising a substrate sheet and a transferable layer disposed on one side surface of the substrate sheet, the transferable layer being peelable from the substrate sheet, wherein the transferable layer comprises a superposition comprising a dye receptor layer, an intermediate layer disposed thereon, a bubble containing layer disposed on the intermediate layer and an adhesive layer disposed on the bubble containing layer.

* * * * *